US010944187B2

(12) United States Patent
Takeuchi et al.

(10) Patent No.: US 10,944,187 B2
(45) Date of Patent: Mar. 9, 2021

(54) TERMINAL AND CONNECTOR

(71) Applicants: AutoNetworks Technologies, Ltd., Yokkaichi (JP); Sumitomo Wiring Systems, Ltd., Yokkaichi (JP); SUMITOMO ELECTRIC INDUSTRIES, LTD., Osaka (JP); TOYOTA JIDOSHA KABUSHIKI KAISHA, Toyota (JP)

(72) Inventors: Shunya Takeuchi, Yokkaichi (JP); Hajime Kawase, Yokkaichi (JP); Masaaki Tabata, Yokkaichi (JP); Yasuo Omori, Yokkaichi (JP); Teruo Hara, Yokkaichi (JP); Hajime Matsui, Yokkaichi (JP); Masahide Hio, Yokkaichi (JP); Hideki Matsunaga, Yokkaichi (JP); Yoshihiro Mizutani, Yokkaichi (JP); Takamaru Amano, Yokkaichi (JP); Takeshi Misaiji, Seto (JP); Hiroshi Kobayashi, Okazaki (JP)

(73) Assignees: AutoNetworks Technologies, Ltd.; Sumitomo Wiring Systems, Ltd.; Sumitomo Electric Industries, Ltd.; Toyota Jidosha Kabushiki Kaisha

( * ) Notice: Subject to any disclaimer, the term of this patent is extended or adjusted under 35 U.S.C. 154(b) by 44 days.

(21) Appl. No.: 16/271,928

(22) Filed: Feb. 11, 2019

(65) Prior Publication Data

US 2019/0252803 A1 Aug. 15, 2019

(30) Foreign Application Priority Data

Feb. 15, 2018 (JP) ..... JP2018-025369

(51) Int. Cl.
*H01R 4/24* (2018.01)
*H01R 4/26* (2006.01)
(Continued)

(52) U.S. Cl.
CPC ..... *H01R 4/26* (2013.01); *H01R 4/188* (2013.01); *H01R 4/20* (2013.01); *H01R 13/424* (2013.01); *H01R 13/506* (2013.01)

(58) Field of Classification Search
CPC . H01R 4/26; H01R 4/188; H01R 4/20; H01R 13/424; H01R 13/506
(Continued)

(56) References Cited

U.S. PATENT DOCUMENTS 6,827,613 B2 12/2004 Ferderer
7,905,744 B1 3/2011 Amidon
(Continued)

FOREIGN PATENT DOCUMENTS

CN 203813058 9/2014
CN 105305124 2/2016
(Continued)

*Primary Examiner* — Khiem M Nguyen
(74) *Attorney, Agent, or Firm* — Gerald E. Hespos; Michael J. Porco; Matthew T. Hespos

(57) ABSTRACT

A female terminal 12 is a female terminal including a terminal body 15 including a deformable upper connection piece 18A and a deformable lower connection piece 18B, the upper and lower connection pieces 18A and 18B having contact surfaces 21A and 21B that come in contact with a core 13 of a wire 11, respectively, and extending in an extension direction, and a slide 16 configured to move along the extension direction. The slide 16 has an upper contact portion 25A and a lower contact portion 25B that press the upper connection piece 18A and the lower connection piece 18B, respectively, to the core 13 while the core 13 is disposed in contact with the contact surfaces 21A and 21B of the upper and lower connection pieces 18A and 18B along the extension direction.

17 Claims, 25 Drawing Sheets

(51) Int. Cl.

| | |
|---|---|
| ***H01R 13/424*** | (2006.01) |
| ***H01R 4/20*** | (2006.01) |
| ***H01R 13/506*** | (2006.01) |
| ***H01R 4/18*** | (2006.01) |

(58) Field of Classification Search
USPC ..... 439/436–441
See application file for complete search history.

(56) References Cited

U.S. PATENT DOCUMENTS

| | | | | |
|---|---|---|---|---|
| 7,905,745 | B2 * | 3/2011 | Watanabe | H01R 4/62 439/442 |
| 8,628,363 | B2 * | 1/2014 | Kobayashi | H01R 4/206 439/877 |
| 9,048,606 | B2 * | 6/2015 | Shinmi | H01R 4/184 |
| 9,190,743 | B2 * | 11/2015 | Sato | H01R 4/70 |
| 9,424,966 | B2 * | 8/2016 | Kondo | H01R 4/023 |
| 2003/0104732 | A1 | 6/2003 | Ferderer | |
| 2005/0026515 | A1 | 2/2005 | Hashimoto et al. | |

FOREIGN PATENT DOCUMENTS

| | | |
|---|---|---|
| GB | 844 444 | 8/1960 |
| JP | S15-000085 | 6/1940 |
| JP | 5-023422 | 3/1993 |
| JP | 2003-168498 | 6/2003 |
| JP | 2005-50736 | 2/2005 |
| JP | 2010-102979 | 5/2010 |
| JP | 2016-225248 | 12/2016 |

* cited by examiner

TERMINAL AND CONNECTOR

CROSS REFERENCE TO RELATED APPLICATION

This application claims priority from Japanese Patent Application No. 2018-025369 filed on Feb. 15, 2018. The entire contents of the priority application are incorporated herein by reference.

BACKGROUND

Field of the Invention

A technique disclosed in the present description relates to a connection structure of a terminal and a wire.

Related Art

A wire with a terminal has been known as a structure in which a terminal is connected to a core exposed from an end of a wire. An example of a terminal of such a structure is a terminal provided with a pressure-bonding portion pressure bonded from outside to a core exposed from an end of a wire.

The above terminal is press bonded to a wire by, for example, the following process. First, a metal plate is press worked into a terminal of a predetermined shape. Subsequently, the terminal is placed on a bearing section of a lower die of a pair of dies configured to move vertically relative to each other, the lower die being located on the lower side. A core exposed from an end of a wire is then superposed on a pressure-bonding portion of the terminal. Afterward, one or both of the pair of dies are moved in a direction of bringing the dies closer to each other to sandwich the pressure-bonding portion between a pressure-bonding section of an upper die and the bearing section of the lower die. The pressure-bonding portion is thus pressure bonded to the core of the wire. Through this process, the terminal is connected to the end of the wire (see Japanese Unexamined Patent Application Publication No. 2005-50736).

However, the technique described above requires relatively large equipment, such as dies and jigs for pressure bonding the pressure-bonding portion of the terminal to the wire core. This creates a need of equipment investment, thus posing a problem of an increase in manufacturing costs.

A technique disclosed in the present description has been accomplished in view of the above circumstances, and it is therefore an object of the present disclosure to provide a technique by which a terminal and a wire can be connected together without using a relatively large jig.

SUMMARY

According to a technique disclosed in the present description, a terminal includes a terminal body including a deformable connection piece having a contact surface that comes in contact with a wire, the connection piece extending in an extension direction, and a slide configured to move relative to the terminal body along the extension direction. The slide has a pressing portion that presses the connection piece to the wire while the wire is disposed in contact with the contact surface of the connection piece along the extension direction.

According to this configuration, by moving the slide along the extension direction, the connection piece can be pressed to the wire. As a result, the connection piece is electrically connected to the wire. Thus, the wire and the terminal can be electrically connected together without using a relatively large jig.

The following modes are preferable as modes for carrying out the technique disclosed in the present description.

It is preferable that the pressing portion of the slide may be a contact portion that comes in contact with the connection piece from a side opposite to the contact surface.

According to this configuration, by bringing the contact portion into contact with the connection piece from the side opposite to the contact surface of the connection piece, the connection piece can be pressed to the wire.

It is preferable that the slide may be configured to move between a contact position at which the contact portion is in contact with the connection piece and a separation position at which the contact portion is separated from the connection piece.

According to this configuration, by carrying out a simple operation of moving the slide from the separation position to the contact position relative to the terminal body, the wire and the terminal can be electrically connected together.

It is preferable that the slide may be of a cylindrical shape extending in the extension direction and may have a guide-in portion located on a part of the slide that is closer to a rear end of the slide in the extension direction, and the guide-in portion may taper as the guide-in portion extends frontward in the extension direction and may come in slide contact with the wire to guide the wire to an interior of the slide.

According to this configuration, by causing the wire to come in slide contact with the guide-in portion, the wire can be inserted easily into the slide of the cylindrical shape.

It is preferable that the slide may be provided with a jig contact portion projecting outward, and a push to the jig contact portion by a jig from a rear side of the jig contact portion in the extension direction may cause the slide to slide frontward in the extension direction.

According to this configuration, by bringing the jig into contact with the jig contact portion to push the slide frontward in the extension direction, the wire and the terminal can be electrically connected together. The above jig does not require relatively large equipment, such as a die, and therefore does not cause a significant cost increase resulting from equipment investment.

It is preferable that the connection piece may have a holding projection projecting from the contact surface, and the holding projection may come in contact with the wire to hold the wire in a state of being bent in a direction intersecting the extension direction.

According to this configuration, because the holding projection holds the wire in the state of being bent in the direction intersecting the extension direction, when a pulling force acts on the wire, the holding projection receives such a pulling force. As a result, the terminal and the wire are firmly held together.

It is preferable that the contact surface may have serrations formed thereon, and the serrations may cut into a surface of the wire while the connection piece is pressed to the wire.

According to this configuration, the serrations cutting into the surface of the wire enhance a holding force holding the wire and the terminal together. In addition, the serrations peel off an insulative film covering the surface of the wire. This reduces electric resistance between the terminal and the wire.

It is preferable that the serrations may be formed as grooves extending in a direction perpendicular to the extension direction and may be lined up at intervals in the extension direction.

According to this configuration, the wire can be held by the serrations on a plurality of parts of the wire in the extension direction. This enhances the holding force holding the wire and the terminal together. In addition, the wire can be electrically connected to the terminal by the serrations on the plurality of parts of the wire in the extension direction. This allows a reduction in electric resistance between the terminal and the wire.

It is preferable that the contact surface may have a wire guide recession formed thereon, and the wire guide recession may extend along the extension direction.

According to this configuration, by laying the wire along the wire guide recession, the wire can be disposed easily on the contact surface.

It is preferable that the wire may have a core and an insulating sheathing covering an outer periphery of the core, the terminal body may have a deformable holding piece having a holding surface that holds the insulating sheathing, the holding piece may extend in the extension direction, the slide may have a holding piece contact portion projecting toward the holding piece, and the holding piece contact portion may come in contact with the holding piece to press the holding piece to the insulating sheathing.

According to this configuration, the insulating sheathing of the wire can be held by the holding piece. This further enhances the holding force holding the wire and the terminal together.

It is preferable that the terminal body may have a terminal window as an opening through which the edge of the wire being placed in a predetermined location is detectable while the wire is disposed along the connection piece.

According to this configuration, by detecting the edge of the wire through the terminal window, whether the wire is connected to the terminal can be determined easily.

It is preferable that one of the terminal body and the slide may be provided with a separation position lock portion while the other of the terminal body and the slide may be provided with a separation position lock engaging portion, engaging the separation position lock portion with the separation position lock engaging portion may hold the slide at the separation position, one of the terminal body and the slide may be provided with a contact position lock portion while the other of the terminal body and the slide may be provided with a contact position lock engaging portion, and engaging the contact position lock portion with the contact position lock engaging portion may hold the slide at the contact position.

According to this configuration, relative to the slide, the terminal body can be held at the separation position and at the contact position as well.

A connector according to the technique disclosed in the present description is a connector including a connector housing having a cavity in which the terminal is housed, and a rear holder fitted on a rear end of the connector housing in the extension direction of the terminal housed in the cavity. On a rear end of the rear holder in the extension direction, an insertion hole is formed as an opening communicating with the cavity.

According to this configuration, the rear holder holds the terminal in the connector housing such that the terminal is prevented from slipping off.

The following modes are preferable as modes for carrying out the technique disclosed in the present description.

It is preferable that the slide may have a contact portion that comes in contact with the connection piece from a side opposite to the contact surface, the slide may be configured to move between a contact position at which the contact portion is in contact with the connection piece and a separation position at which the contact portion is separated from the connection piece, the rear holder may be configured to move along the extension direction, the rear holder may have a slide pushing portion on the front end of the rear holder in the extension direction, and the slide pushing portion may come in contact with the slide from a rear side in the extension direction to push the slide frontward in the extension direction, thereby causing the slide to move to the contact position when the rear holder moves from the rear side to the front side in the extension direction.

According to this configuration, moving the rear holder causes the slide pushing portion of the rear holder to push the slide. As the rear holder is moved, therefore, the wire and the terminal are electrically connected together at the same time.

It is preferable that the slide may have a contact portion that comes in contact with the connection piece from a side opposite to the contact surface, the slide may be configured to move between a contact position at which the contact portion is in contact with the contact surface and a separation position at which the contact portion is separated from the connection piece, the rear holder may be configured to move between a temporary lock position at which the rear holder is locked at a location closer to a rear end of the connector housing and a full-lock position located more frontward in the extension direction than the temporary lock position, and the front end of the rear holder in the extension direction may be in contact with the slide when the slide is not at the contact position.

According to this configuration, a state in which the terminal and the wire are incompletely connected because of the slide not being at the contact position can be detected by confirming a fact that the rear holder is in contact with the slide.

It is preferable that the terminal body may have a terminal window as an opening through which the edge of the wire being placed in a predetermined location is detectable while the wire is disposed along the connection piece, and the connector housing may be provided with a connector window through which the terminal window of the terminal communicates with an outside.

According to this configuration, whether the edge of the wire is placed in the predetermined location can be detected by peeking in the terminal window through the connector window.

According to the technique disclosed in the present description, the terminal and the wire can be connected together without using a relatively large jig.

DETAILED DESCRIPTION

First Embodiment

A first embodiment of a technique disclosed in the present description will now be described with reference to FIGS. 1 to 26. A connector 10 according to the present embodiment houses a female terminal 12 (an example of a terminal) connected to an end of a wire 11. The following description will be made on the assumption that an arrow representing the Z direction points at the upper side, an arrow representing the Y direction points at the front side, and an arrow representing the X direction points at the left side. When a plurality of the same members are present, reference symbols may be given to some of the members only and not given to the rest of the members.

(Wire 11)

Figure 2:
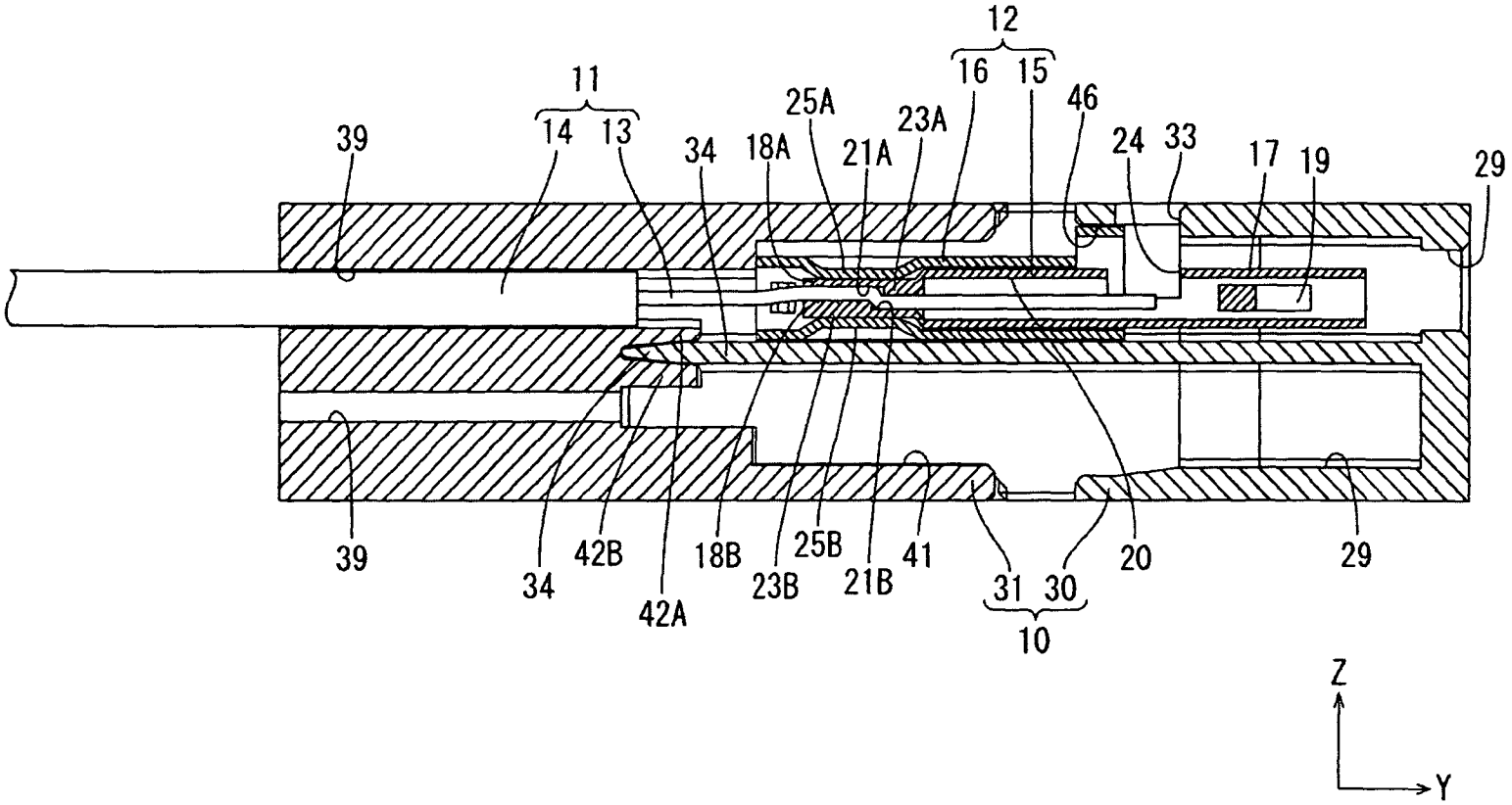
FIG. 2 is a sectional view of the connector.

As shown in FIG. 2, a wire 11 is constructed by covering an outer peripheral surface of a core 13 with an insulating sheathing 14 made of an insulative synthetic resin. An end portion of the insulating sheathing 14 is peeled to expose the core 13. The core 13 according to the present embodiment is a so-called single core that is a single metal wire. The core 13 may be a stranded wire formed by stranding a plurality of thin metal wires together. A metal making up the core 13 can be selected properly from a group of metals, such as copper, copper alloy, aluminum, and aluminum alloy, according to a need. The core 13 according to the present embodiment is made of copper or copper alloy.

(Terminal Body 15)

Figure 3:
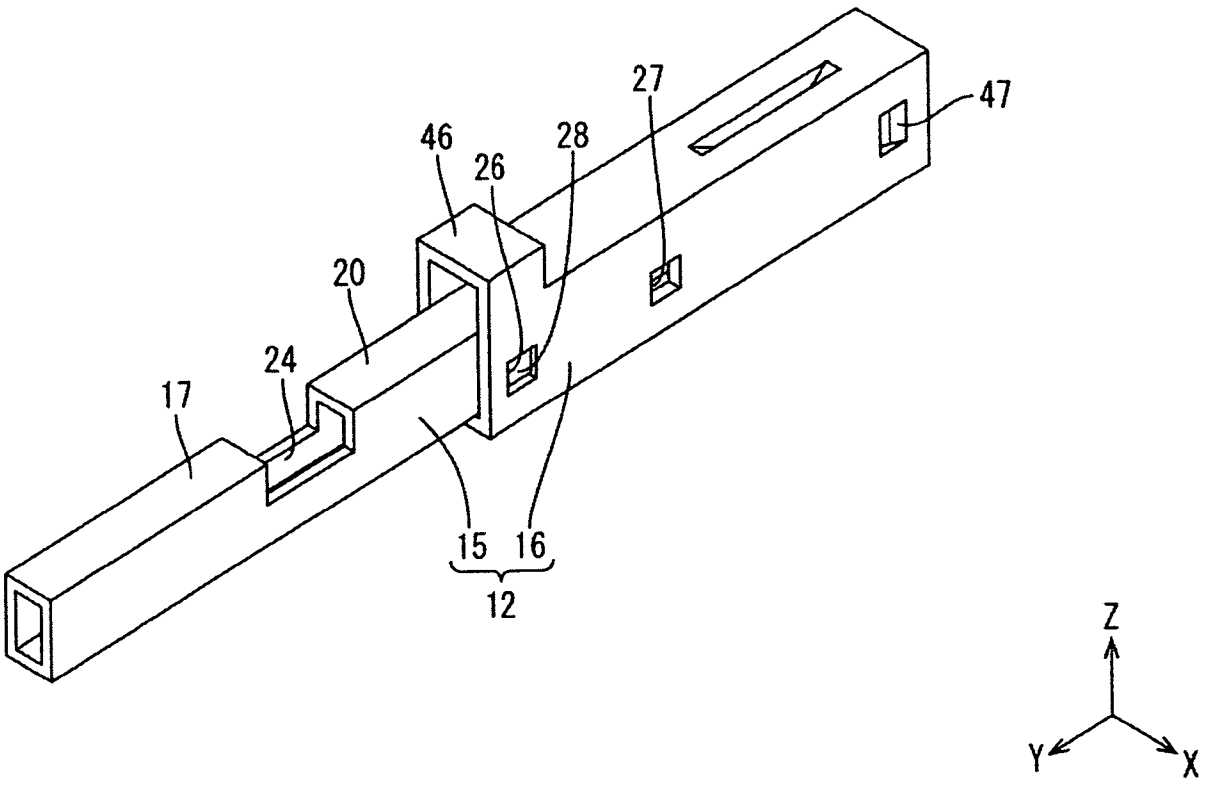
FIG. 3 is a perspective view of a female terminal in a state in which a slide is temporarily locked to a terminal body.
Figure 4:
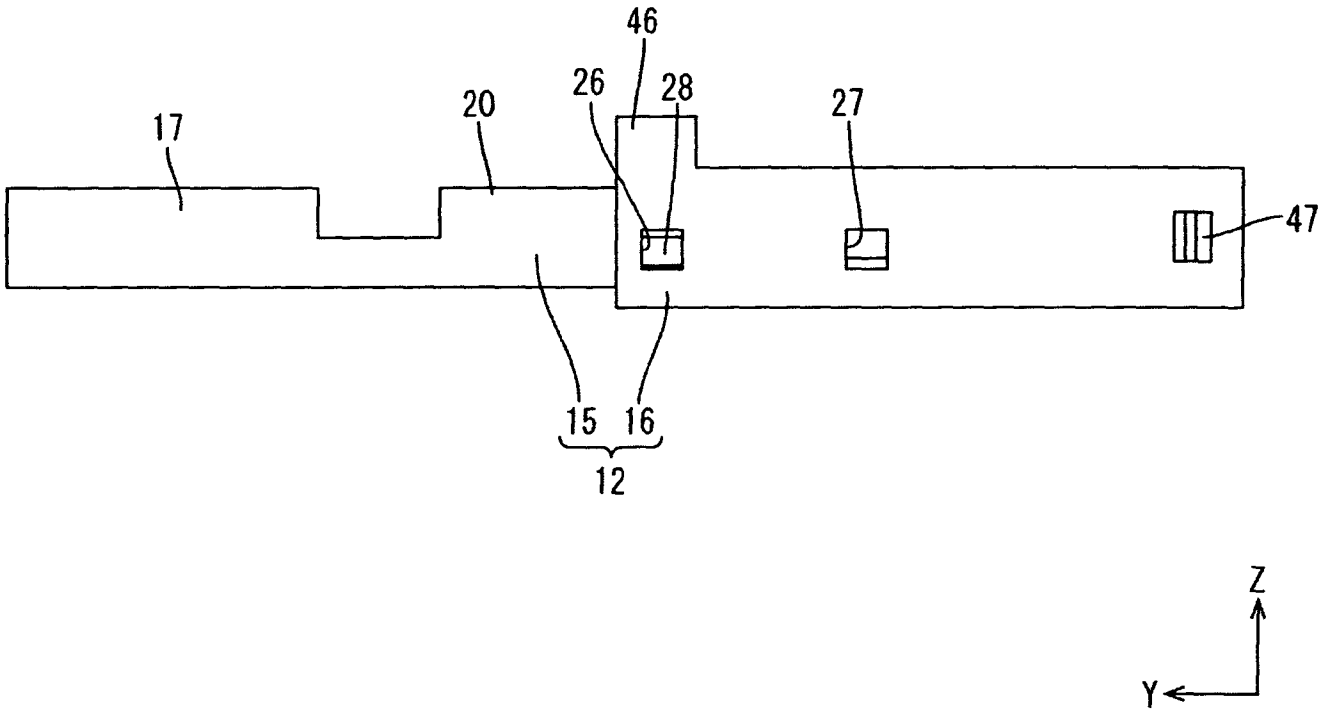
FIG. 4 is a side view of the female terminal in a state in which the slide is temporarily locked to the terminal body.
Figure 5:
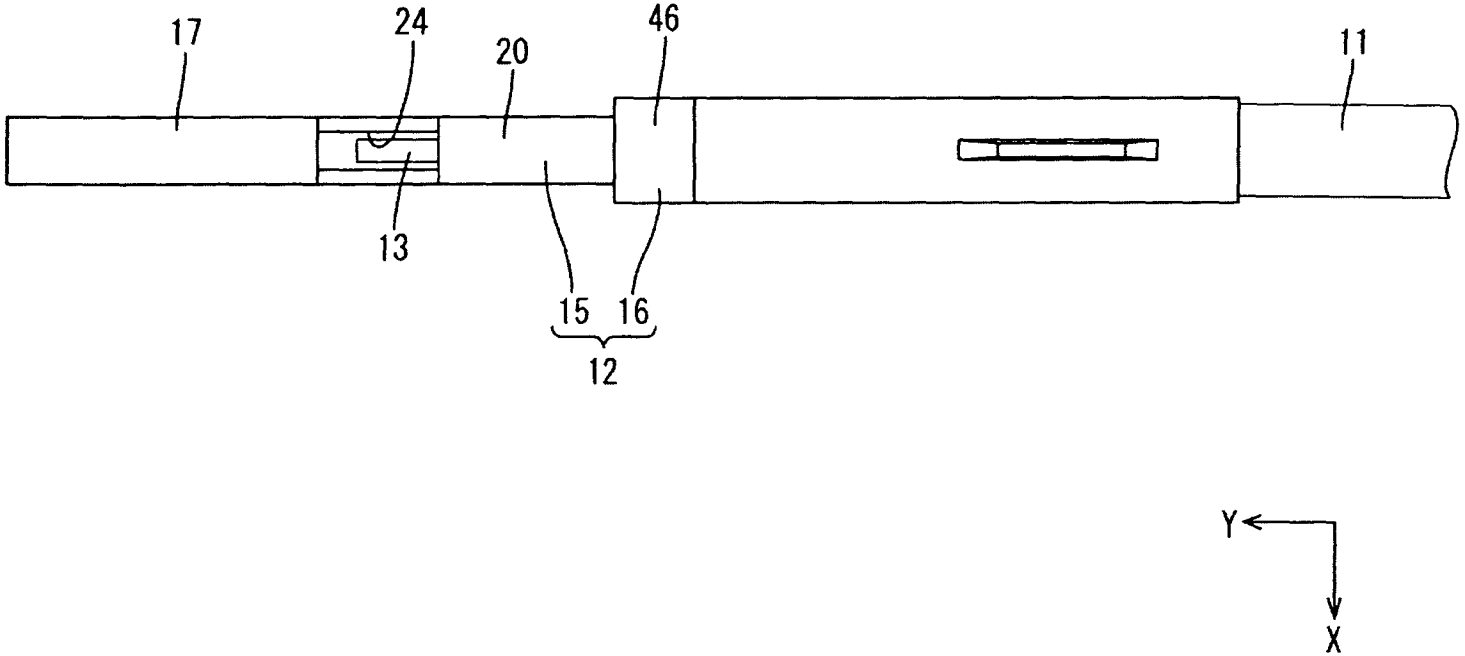
FIG. 5 is a plan view of the female terminal in a state in which the slide is temporarily locked to the terminal body.
Figure 6:
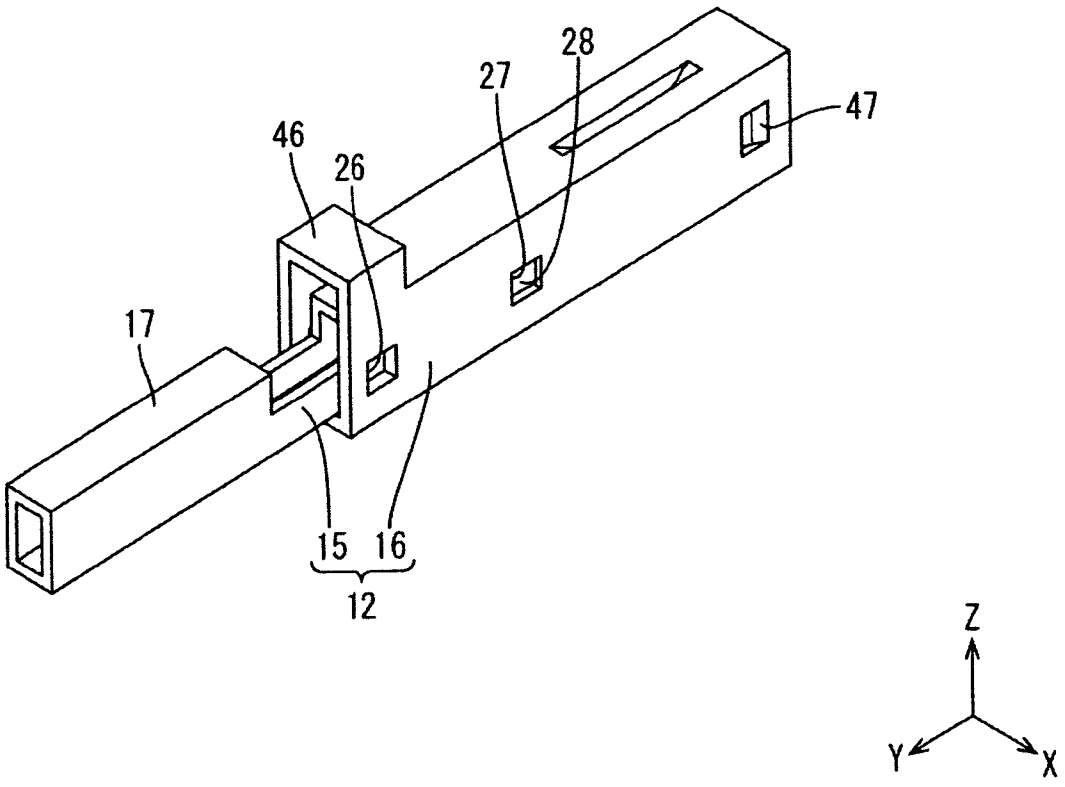
FIG. 6 is a perspective view of the female terminal in a state in which the slide is fully locked to the terminal body.
Figure 7:
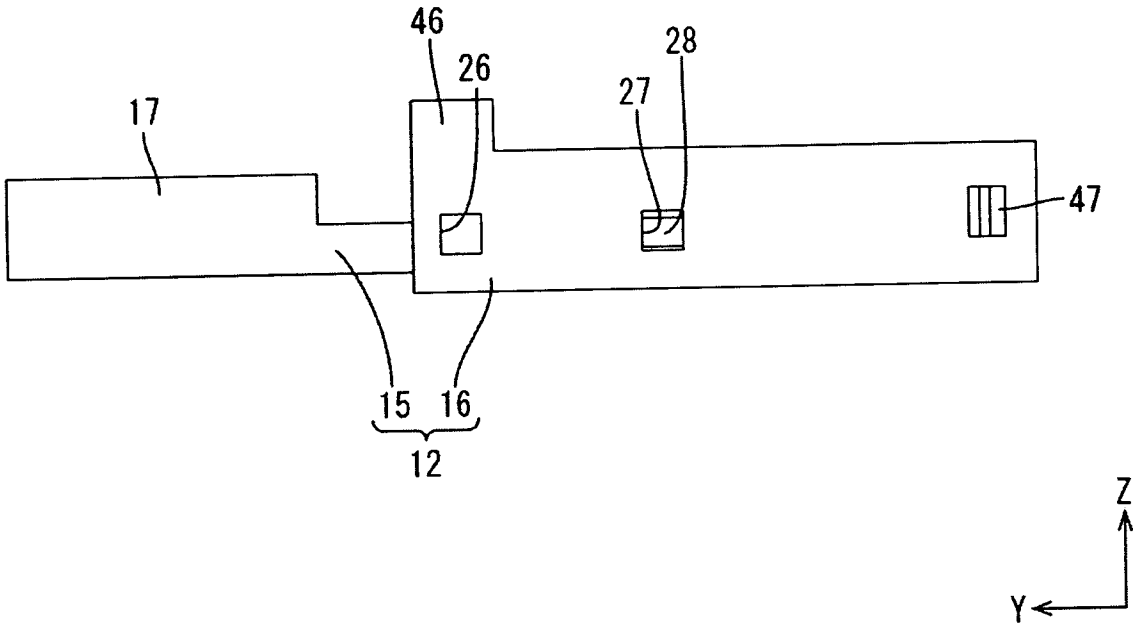
FIG. 7 is a side view of the female terminal in a state in which the slide is fully locked to the terminal body.

As shown in FIGS. 2 to 4, a female terminal 12 includes a terminal body 15 made of a metal, and a slide 16 slidable relative to the terminal body 15. The terminal body 15 is made into a predetermined shape by a known method, such as press working, cutting, and casting. A metal making up the terminal body 15 can be selected properly from a group of metals, such as copper, copper alloy, aluminum, aluminum alloy, and stainless steel, according to a need. The terminal body 15 according to the present embodiment is made of copper or copper alloy. The surface of the terminal body 15 may be coated with a plating layer. A metal making up the plating layer can be selected properly from a group of metals, such as tin, nickel, and silver, according to a need. The terminal body 15 according to the present embodiment is plated with tin.

Figure 8:
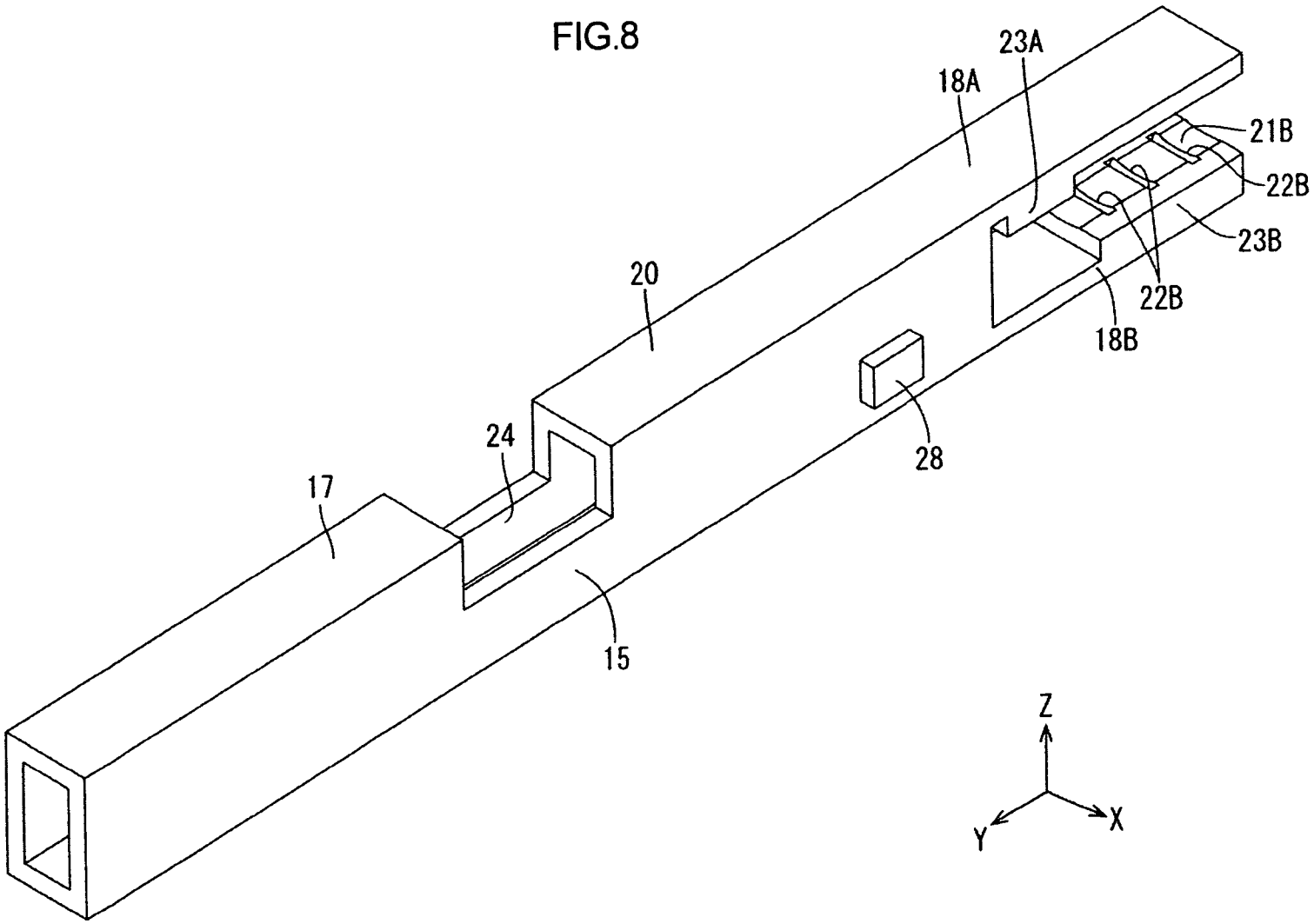
FIG. 8 is a perspective view of the terminal body.
Figure 9:
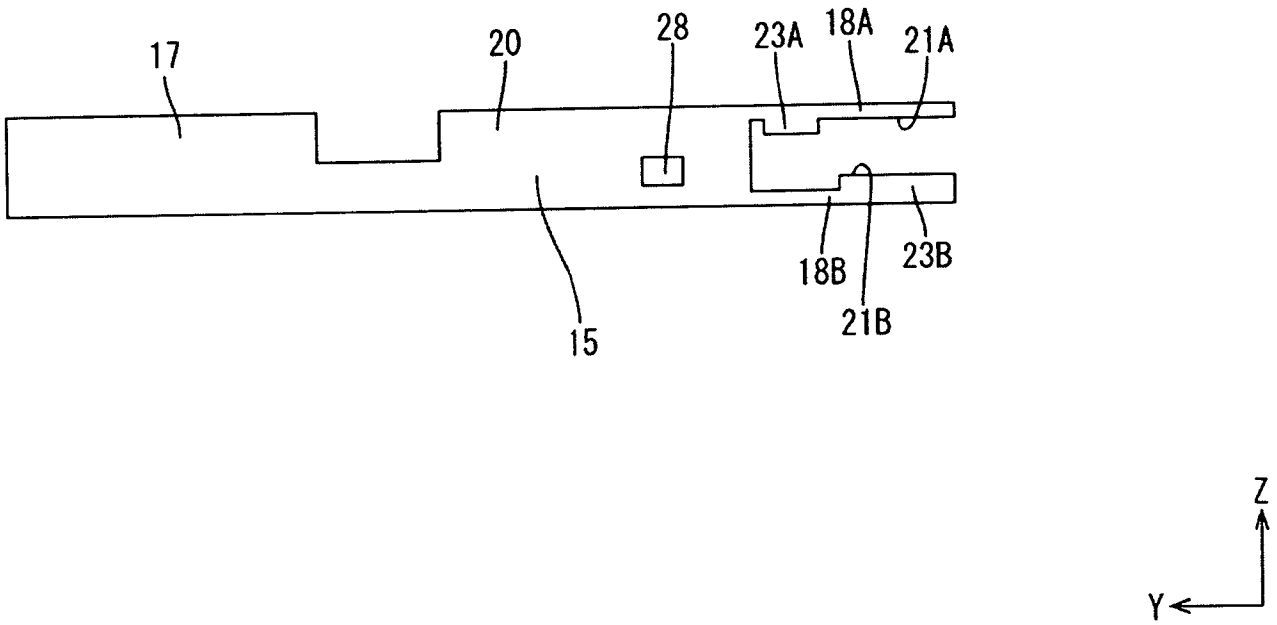
FIG. 9 is a side view of the terminal body.

As shown in FIGS. 8 and 9, the terminal body 15 has a connection cylindrical portion 17 in which an opponent male terminal (not depicted) is inserted, and an upper connection piece 18A and a lower connection piece 18B, the upper and lower connection pieces 18A and 18B extending rearward from the connection cylindrical portion 17. The connection cylindrical portion 17 is of a rectangular cylindrical shape extending in the front-to-rear direction. The front end of the connection cylindrical portion 17 is formed as an opening in which the opponent male terminal can be inserted.

As shown in FIG. 2, inside the connection cylindrical portion 17, an elastic contact piece 19 is placed, the elastic contact piece 19 extending frontward from a rear part of the connection cylindrical portion 17 and being elastically deformable. The male terminal inserted in the connection cylindrical portion 17 comes in contact with the elastic contact piece 19.

At the rear side of the connection cylindrical portion 17, a base 20 of a rectangular cylindrical shape is provided. On the rear end of an upper wall of the base 20, the upper connection piece 18A (an example of the connection piece) is provided to extend rearward. On the rear end of a lower wall of the base 20, the lower connection piece 18B (an example of the connection piece) is provided to extend rearward. The upper connection piece 18A as well as the lower connection piece 18B is of a long and narrow shape extending in the front-to-rear direction (an example of an extension direction). The upper connection piece 18A and the lower connection piece 18B are formed such that their length dimensions in the front-to-rear direction are substantially the same.

The upper connection piece 18A is formed such that it is elastically deformable in the vertical direction on the rear end of the base 20. A lower surface of the upper connection piece 18A serves as a contact surface 21A that comes in contact with the core 13. On the contact surface 21A of the upper connection piece 18A, serrations 22A extending in the left-to-right direction and shaped into grooves are formed such that the serrations 22A are lined up in the front-to-rear direction. On the contact surface 21A of the upper connection piece 18A, an upper holding projection 23A projecting downward is provided at a location slightly shifted frontward from the rear end of the upper connection piece 18A. The serrations 22A may be formed also on a lower surface of the upper holding projection 23A.

The lower connection piece 18B is formed such that it is elastically deformable in the vertical direction on the rear end of the base 20. An upper surface of the lower connection piece 18B serves as a contact surface 21B that comes in contact with the core 13. On the contact surface 21B of the lower connection piece 18B, a wire guide recession 48 recessed downward is formed to extend in the extension direction (front-to-rear direction). On the rear end of the contact surface 21B of the lower connection piece 18B, a lower holding projection 23B projecting upward is provided. On an upper surface of the lower holding projection 23B, serrations 22B extending in the left-to-right direction and shaped into grooves are formed such that the serrations 22B are lined up at intervals in the front-to-rear direction. The lower holding projection 23B and the upper holding projection 23A are provided at respective locations shifted to each other in the front-to-rear direction. The serrations 22B may be formed also on a part of the contact surface 21B of the lower connection piece 18B, the part not having the lower holding projection 23B.

The serrations 22A formed on the upper connection piece 18A and the serrations 22B formed on the lower connection piece 18B cut into an oxide film formed on the surface of the core 13 to peel the oxide film, thereby expose the metal surface of the core 13. This metal surface comes in contact with the contact surface 21A of the upper connection piece 18A and with the contact surface 21B of the lower connection piece 18B. Thus, the core 13 is electrically connected to the terminal body 15.

Figure 10:
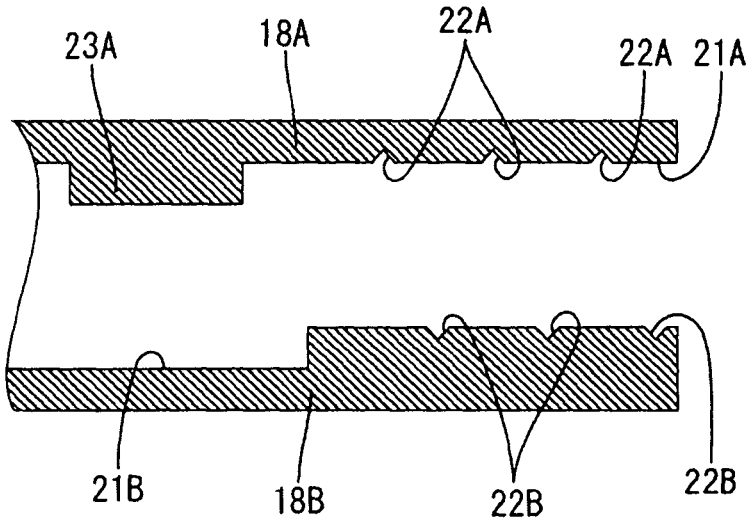
FIG. 10 is a partially enlarged sectional view of serrations.
Figure 11:
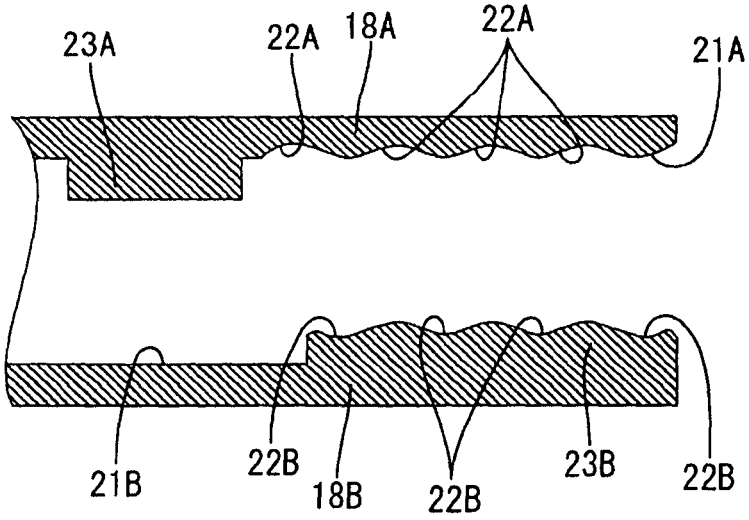
FIG. 11 is a partially enlarged sectional view of a variation of the serrations.
Figure 12:
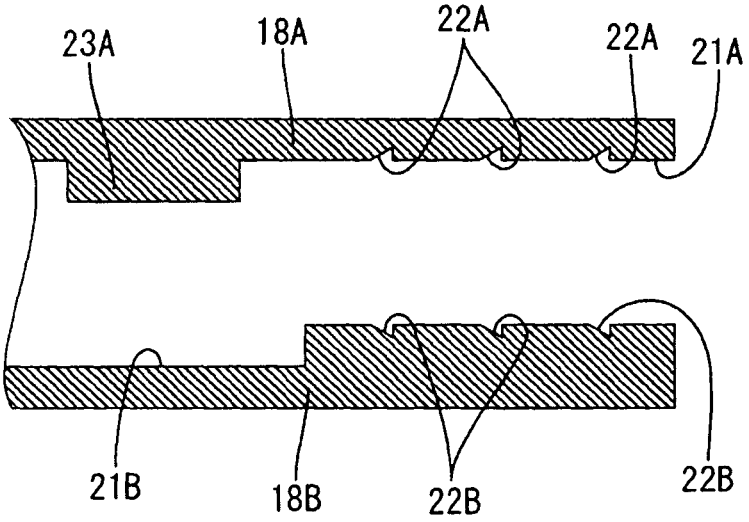
FIG. 12 is a partially enlarged sectional view of a variation of the serrations.
Figure 13:
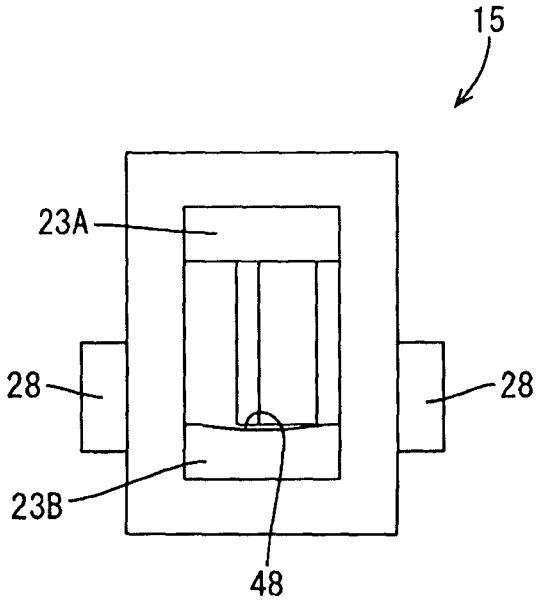
FIG. 13 is a rear view of the terminal body.
Figure 14:
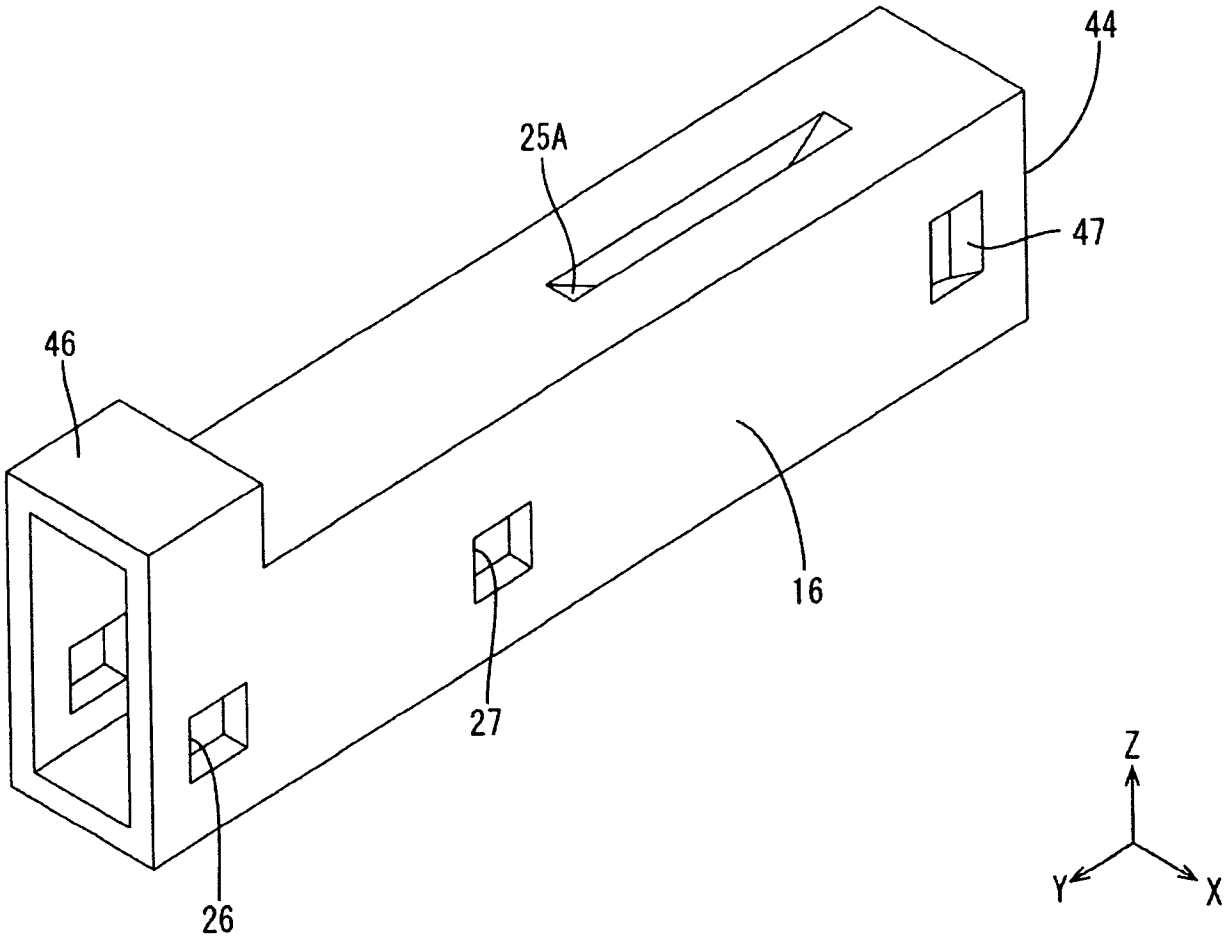
FIG. 14 is a perspective view of the slide.
Figure 15:
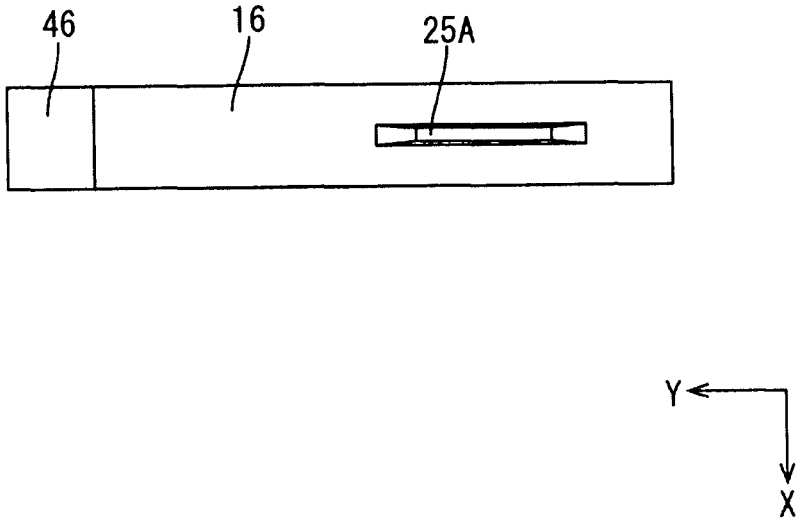
FIG. 15 is a top view of the slide.
Figure 16:
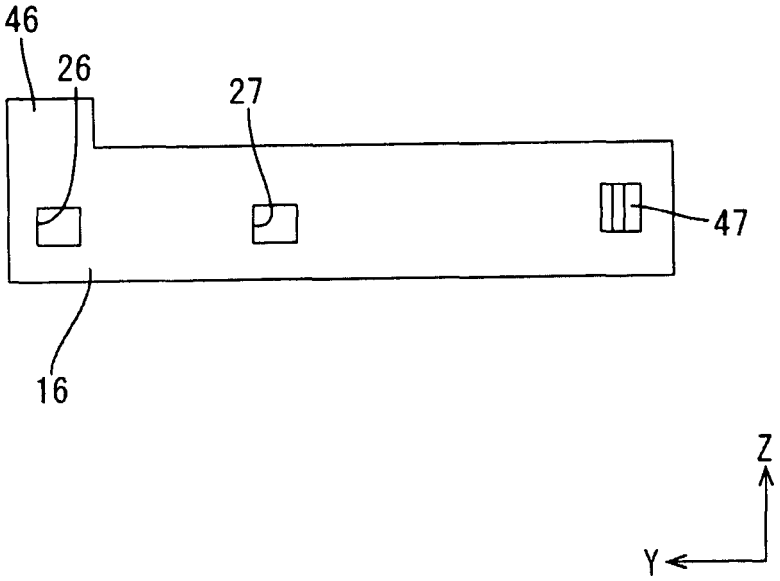
FIG. 16 is a side view of the slide.

As shown in FIGS. 10 to 12, the shape of the serrations 22A and the serrations 22B can be selected properly according to a need. According to the present embodiment, as shown in FIG. 10, the serrations 22A and 22B are so-called V-shaped grooves each having a V-shaped section.

As shown in FIG. 11, the serrations 22A and 22B may be made into waveforms gently waving in the front-to-rear direction.

As shown in FIG. 12, the serrations 22A and 22B may also be made into grooves each composed of a perpendicular rear wall and a front wall having a slope that creates a wider V-shape as the slope extends rearward. In this case, the rear walls of the serrations 22A and 22B cut into the surface of the core 13, thereby enhance a holding force holding the wire 11 and the female terminal 12 together.

Other than the above shapes, any desired shape of the serrations 22A and 22B may also, be adopted. For example, the serrations 22A and 22B may be each made into a so-called U-shaped groove or into a grooved shape with a bottom wall and both side walls crossing at right angles.

The terminal body 15 is provided with a terminal window 24 opening upward that is located at the rear side of the connection cylindrical portion 17 and in front of the base 20. Through the terminal window 24, the front end of the core 13 is detectable from outside while the core 13 is disposed in a space between the upper connection piece 18A and the lower connection piece 18B. That the front end of the core 13 is detectable from outside includes a case where a worker can visually recognize the front end from outside, a case where the front end is detectable from outside by a camera (not depicted), and a case where a probe (not depicted) is inserted from outside to electrically detect the front end of the core 13.

(Slide 16)

As shown in FIGS. 14 to 18, the slide 16 is of a rectangular cylindrical shape extending in the front-to-rear direction (an example of the extension direction). The slide 16 can be formed by a known method, such as cutting, casting, and press working, according to a need. A metal making up the slide 16 can be selected properly from a group of metals, such as copper, copper alloy, aluminum, aluminum alloy, and stainless steel, according to a need. The slide 16 according to the present embodiment is made of copper or copper alloy. The surface of the slide 16 may be coated with a plating layer. A metal making up the plating layer can be selected properly from a group of metals, such as tin, nickel, and silver, according to a need. The slide 16 according to the present embodiment is plated with tin.

The sectional shape of the slide 16 is identical with or slightly larger than the sectional shape of an area of the terminal body 15 that is provided with the upper connection piece 18A and the lower connection piece 18B. As a result, the slide 16 can be fitted on the exterior of the area of the terminal body 15 that is provided with the upper connection piece 18A and the lower connection piece 18B.

A lower surface of an upper wall of the slide 16 is provided with an upper contact portion 25A projecting downward (an example of a pressing portion and a contact portion). An upper surface of a lower wall of the slide 16 is provided with a lower contact portion 25B projecting upward (an example of the pressing portion and the contact portion).

On side walls of the slide 16, temporary lock engaging portions 26 (an example of a separation position lock engaging portion) are formed as openings located closer to the front end in the front-to-rear direction. On the side walls of the slide 16, full-lock engaging portions 27 (an example of a contact position lock engaging portion) are formed as openings located more rearward than the temporary lock engaging portions 26. The temporary lock engaging portions 26 and the full-lock engaging portions 27 can be elastically engaged with lock projections 28 (an example of a separation position lock portion and a contact position lock portion) provided on side walls of the terminal body 15.

A state in which the lock projections 28 of the terminal body 15 are engaged with the temporary lock engaging portions 26 of the slide 16 is a state in which the slide 16 is held at a temporary lock position relative to the terminal body 15. In this state, the upper contact portion 25A and the lower contact portion 25B of the slide 16 are located at a separation position separated rearward from the rear edges of the upper connection piece 18A and the lower connection piece 18B of the terminal body 15. In this state, a gap between the upper connection piece 18A and the lower connection piece 18B is determined to be larger than the diameter of the core 13.

A state in which the lock projections 28 of the terminal body 15 are engaged with the full-lock engaging portions 27 of the slide 16 is a state in which the slide 16 is held at a full-lock position relative to the terminal body 15. In this state, the upper contact portion 25A of the slide 16 is in contact with the upper connection piece 18A from a side (from above) opposite to the contact surface 21A of the upper connection piece 18A of the terminal body 15. Meanwhile, the lower contact portion 25B of the slide 16 is in contact with the lower connection piece 18B from a side (from below) opposite to the contact surface 21B of the lower connection piece 18B of the terminal body. In this manner, the position at which the slide 16 is fully locked to the terminal body 15 is the contact position at which the upper contact portion 25A is in contact with the upper connection piece 18A as the lower contact portion 25B is in contact with the lower connection piece 18B.

As described above, the slide 16 in a state of being fitted on the exterior of the area of the terminal body 15 that is provided with the upper connection piece 18A and the lower connection piece 18B can slide between the temporary lock position and the full-lock position. According to the present embodiment, the lock projections 28 formed on the terminal body 15 serve both as the separation position lock portions and the contact position lock portions.

As described above, when the slide 16 is in a state of being held at the full-lock position relative to the terminal body 15, the upper contact portion 25A is in contact from above with an upper surface of the upper connection piece 18A and the lower contact portion 25B is in contact from below with a lower surface of the lower connection piece 18B.

When the slide 16 is in the state of being held at the full-lock position relative to the terminal body 15, the upper contact portion 25A presses the upper connection piece 18A from above to cause the upper connection piece 18A to elastically deform downward. At the same time, the lower contact portion 25B presses the lower connection piece 18B from below to cause the lower connection piece 18B to elastically deform upward. In a state in which the core 13 extending in the front-to-rear direction (extension direction) is disposed in a space between the upper connection piece 18A and the lower connection piece 18B and the slide 16 is held at the full-lock position relative to the terminal body 15, therefore, the core 13 is held between the upper connection piece 18A elastically deformed on the upper side and the lower connection piece 18B elastically deformed on the lower side. In other words, the upper connection piece 18A pressed downward by the upper contact portion 25A comes in contact from above with the core 13 as the lower connection piece 18B pressed upward by the lower contact portion 25B comes in contact from below with the core 13.

Figure 17:
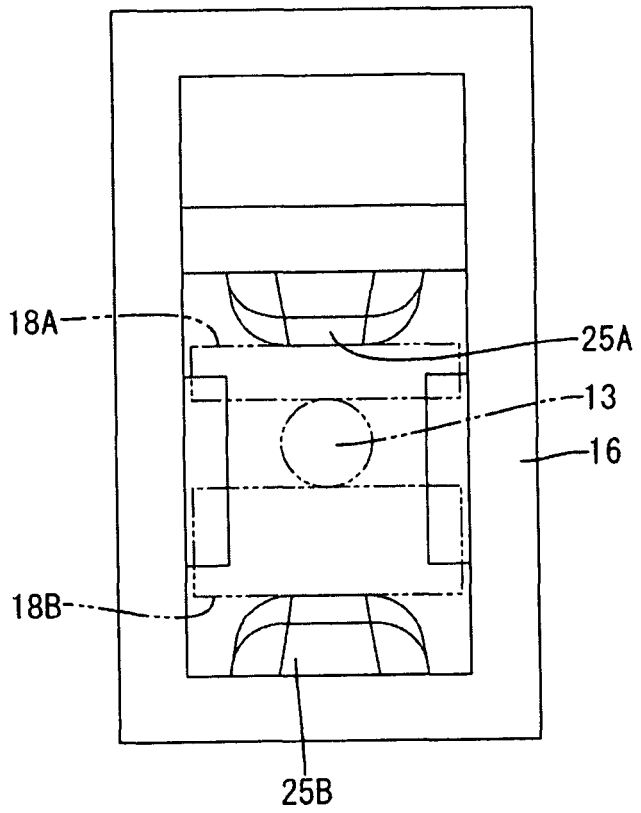
FIG. 17 is a front view of the slide.
Figure 17:
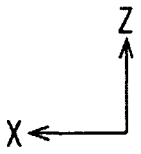
Figure 18:
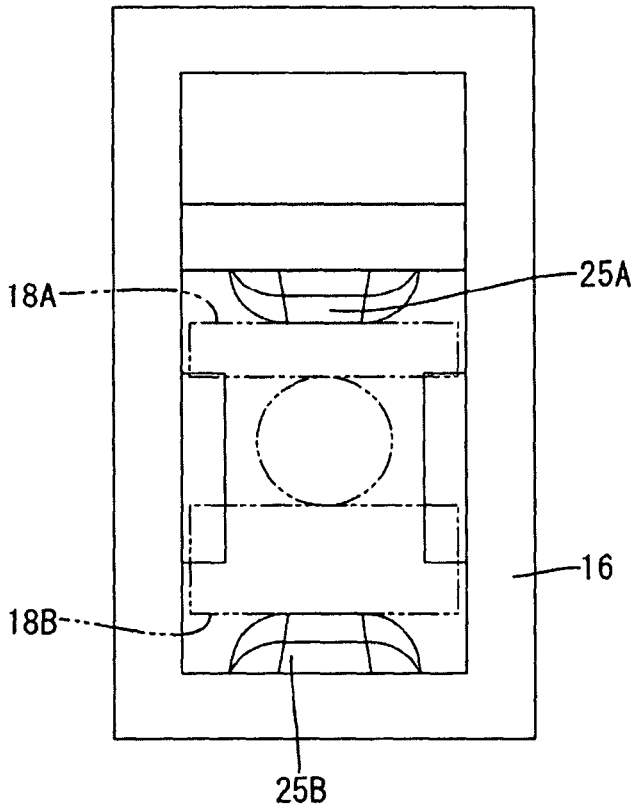
FIG. 18 is a front view of the slide in which the projection height of contact portions is changed.
Figure 18:
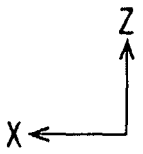

As indicated in FIGS. 17 and 18, by properly changing the height dimension of the upper contact portion 25A and that of the lower contact portion 25B, wires 11 different in the diameter of the core 13 can be connected to the female terminal 12 even if the terminal body 15 of the same shape is used. For example, FIG. 18 shows a case where the height dimension of the upper contact portion 25A and that of the lower contact portion 25B are smaller than those depicted in FIG. 17. In this case, using the terminal body 15 of the same shape, a wire 11 larger in the diameter of the core 13 than a wire 11 depicted in FIG. 17 can be connected to the female terminal 12.

When the slide 16 is in the state of being held at the full-lock position relative to the terminal body 15, the upper holding projection 23A of the upper connection piece 18A presses the core 13 from above as the lower holding projection 23B of the lower connection piece 18B presses the core 13 from below. In this manner, the core 13 is pressed from above by the upper holding projection 23A and is pressed from below by the lower holding projection 23B shifted in location to the upper holding projection 23A in the front-to-rear direction. As a result, the core 13 is held in a state of being bent in the vertical direction (an example of a direction intersecting the extension direction). The upper holding projection 23A and the lower holding projection 23B also bring the core 13 into electric connection to the female terminal 12.

The front end of the slide 16 is provided with a jig contact portion 46 projecting upward from the upper wall of the slide 16. A jig 45 comes in contact from the rear side with the jig contact portion 46 to push the slide 16 frontward, thereby causes the slide 16 to move frontward (see FIG. 26). The jig 45 is of a long and narrow plate-like or bar-like shape. The jig 45 is made of a known material, such as metal and synthetic resin. The jig 45 is relatively small in size, compared to a die or equipment for operating the die. This suppresses a cost increase caused by the jig 45.

On a part of the slide 16 that is closer to its rear end, a pair of guide-in portions 47 projecting toward the interior of the slide 16 are provided on left and right walls, respectively. The guide-in portions 47 are formed such that the guide-in portions 47 taper as they extend from the rear side to the front side. When the core 13 comes in slide contact with the inner surface of the guide-in portions 47, the core 13 is guided to the interior of the slide 16.

(Connector 10)

Figure 1:
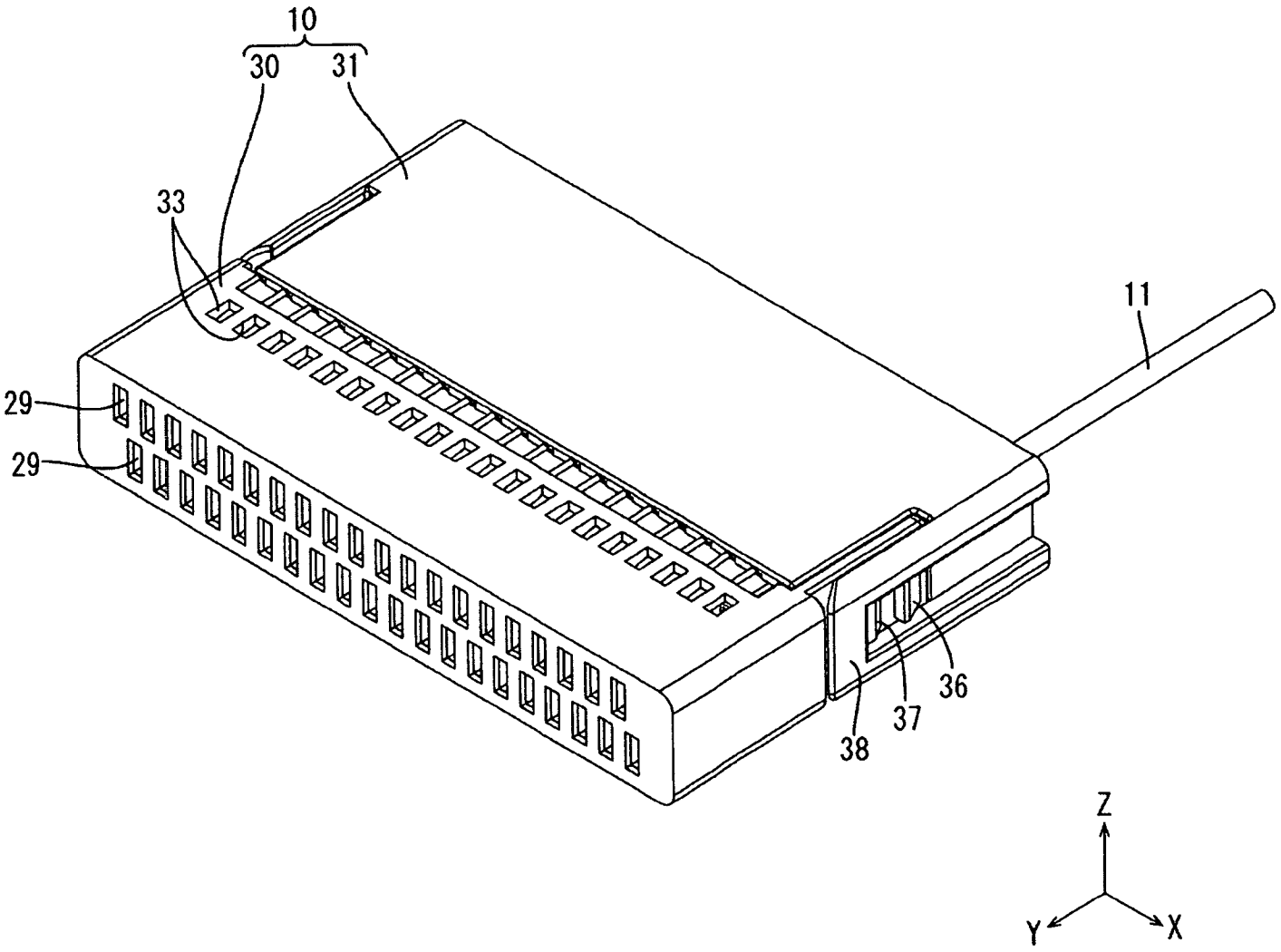
FIG. 1 is a perspective view of a connector according to a first embodiment.

As shown in FIG. 1, the connector 10 includes a connector housing 30 having a plurality of cavities 29 each housing the female terminal 12 therein, and a rear holder 31 fitted on the rear end of the connector housing 30.

(Connector Housing 30)

Figure 19:
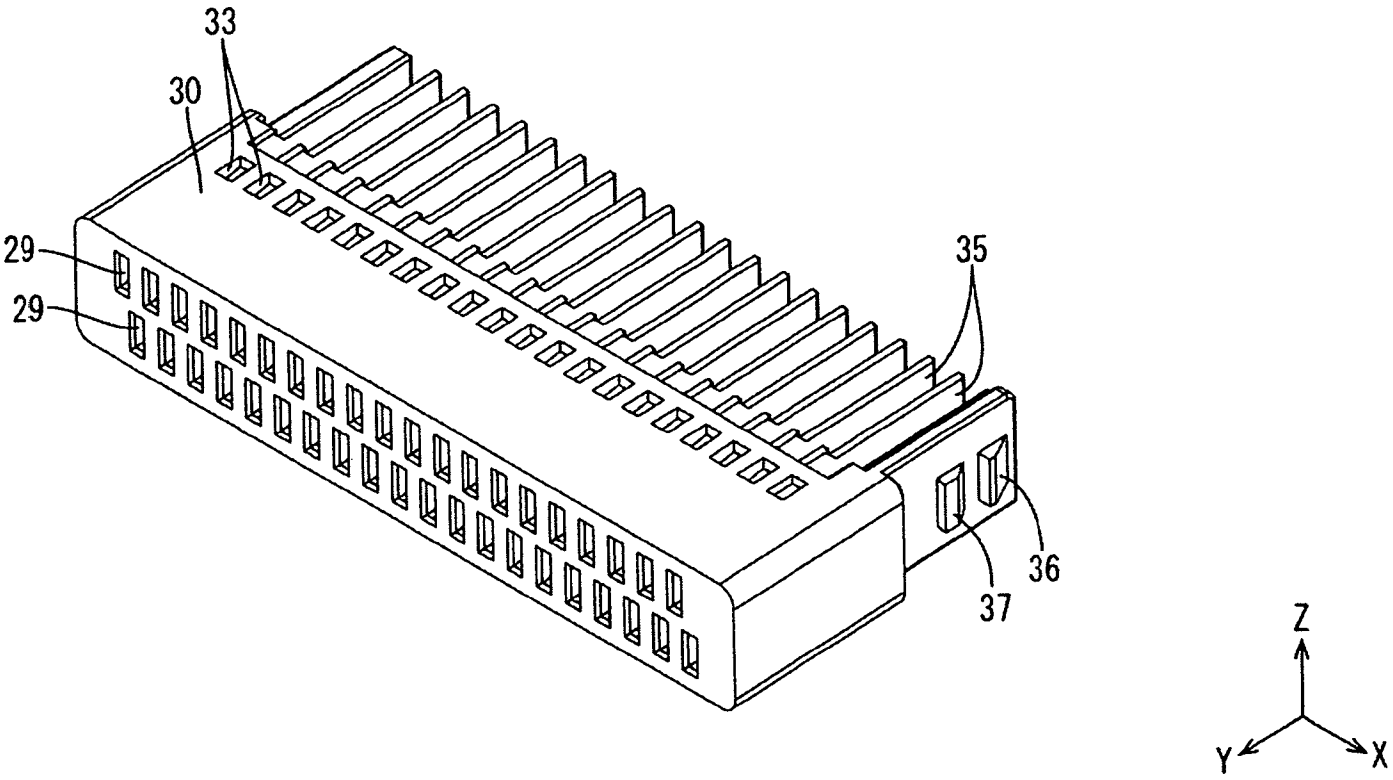
FIG. 19 is a perspective view of a connector housing.
Figure 20:
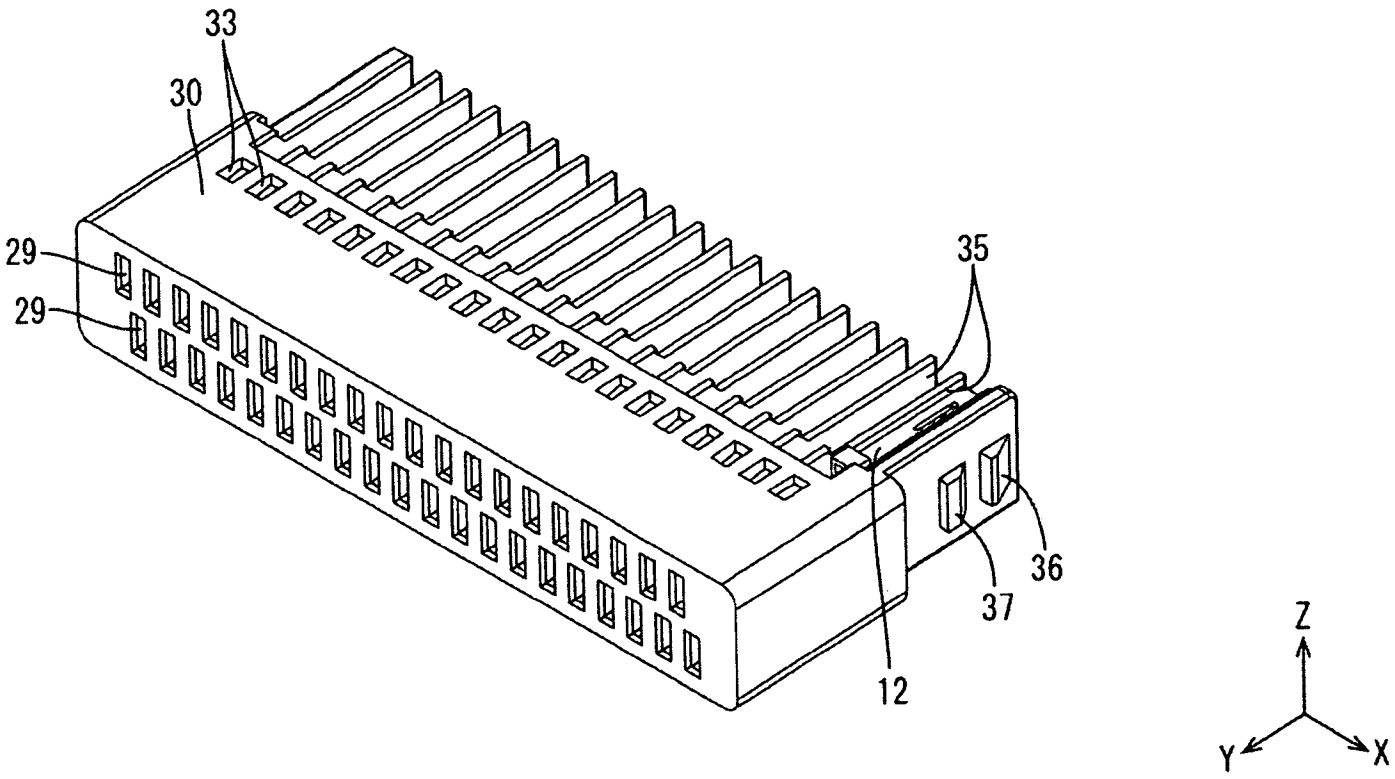
FIG. 20 is a perspective view showing a state in which the female terminal is fitted in the connector housing.
Figure 21:
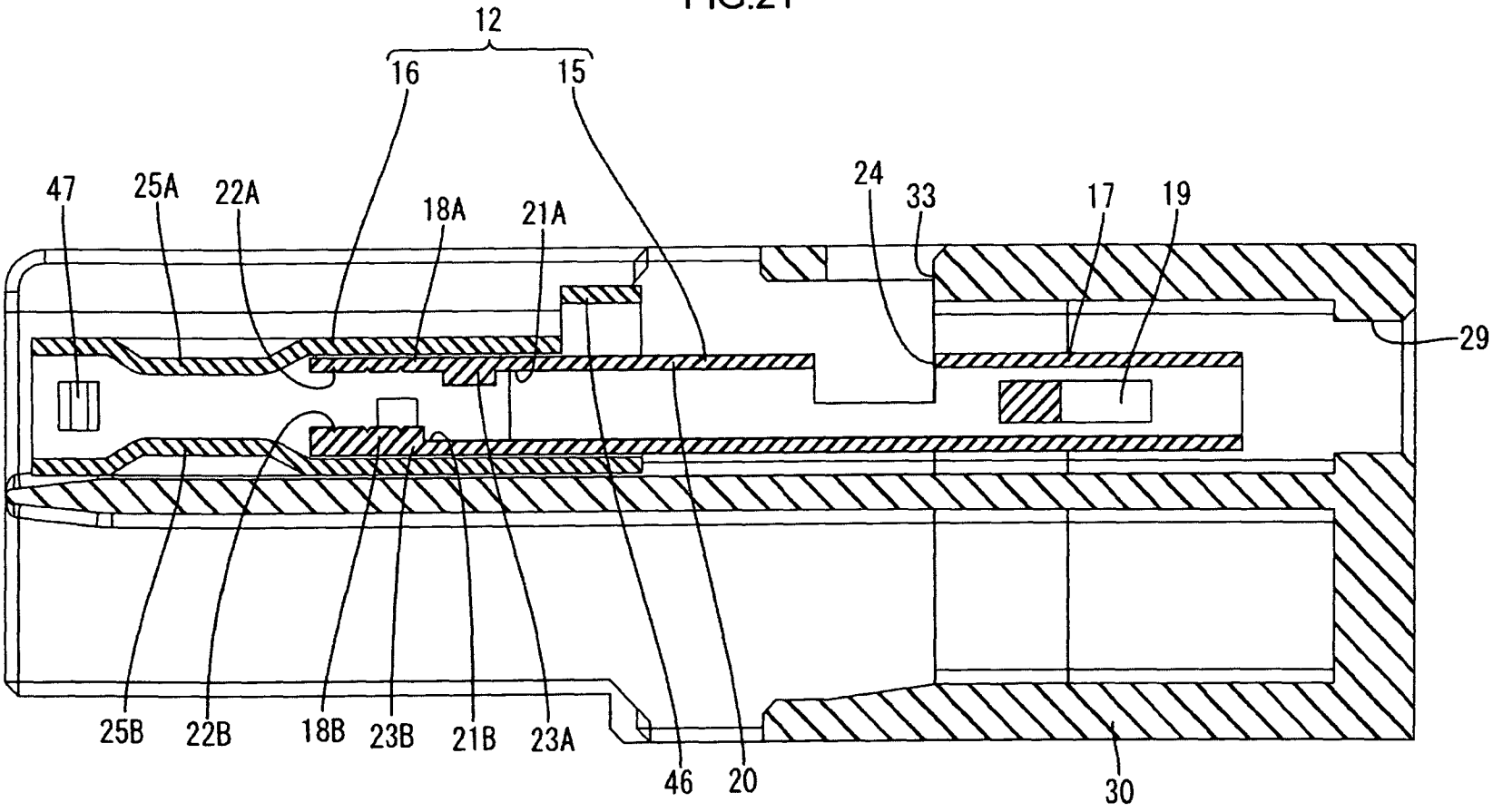
FIG. 21 is a sectional view showing a state in which the female terminal is fitted in the connector housing.

As shown in FIG. 19, the connector housing 30 is substantially a rectangular parallelepiped that is flat in the vertical direction and is stretching in the left-to-right direction. The connector housing 30 is formed by injection molding an insulative synthetic resin. On the connector housing 30, the plurality of cavities 29 extending in the front-to-rear direction, each cavity 29 housing the female terminal 12 therein, are lined up at intervals in the left-to-right direction in upper and lower rows, i.e., two rows. The cavities 29 making up the upper row and the cavities 29 making up the lower row are arranged such that the former cavities 29 and the latter cavities 29 are shifted in location vertically to each other. The number of the cavities 29 may be determined to be any given number, and the number of upper and lower rows of the cavities 29 may also be determined to be any given number.

The front end of each cavity 29 opens frontward, in which a male terminal can be inserted. The rear end of the cavity 29 is a rearward opening, in which the female terminal 12 can be inserted from the rear side.

As shown in FIG. 2, a connector window 33 penetrating a wall that forms the cavity 29 is formed at a location that corresponds to the location of the terminal window 24 of the female terminal 12 as the female terminal 12 is housed in the cavity 29. Through this connector window 33, the terminal window 24 communicates with the outside. From the connector window 33, the terminal window 24 of the female terminal 12 is detectable from outside. Thus, through the connector window 33 and the terminal window 24, the front end of the core 13 is detectable from outside.

The connector housing 30 has a partition 34 serving as a partition between the cavities 29 making up the upper low and the cavities 29 making up the lower row. The partition 34 is extended rearward from the rear end of the cavities 29. An upper surface and a lower surface of the partition 34 are provided respectively with partition walls 35 each extending in the front-to-rear direction and projecting vertically. These partition walls 35 electrically insulate the female terminal 12 housed in each cavity 29 from another female terminal 12 adjacent to the female terminal 12 in the left-to-right direction.

A part of left/right side walls of the connector housing 30, the part being closer to the rear end of the connector housing 30, is provided with temporary lock portions 36 projecting outward, and a part of the left/right side walls that is located more frontward than the temporary lock portions 36 is provided with full-lock portions 37 projecting outward.

(Rear Holder 31)

The rear holder 31 is of a box shape opening frontward. The rear holder 31 is formed by injection molding an insulative synthetic resin. The rear holder 31 is fitted on the rear half part of the connector housing 30. A part of left/right side walls of the rear holder 31, the part being closer to the front end of the rear holder 31, is provided with lock engaging portions 38 configured to be elastically engaged with the temporary lock portions 36 and the full-lock portions 37 of the connector housing 30. The lock engaging portions 38 are almost U-shaped.

As a result of engaging the temporary lock portions 36 of the connector housing 30 with the lock engaging portions 38 of the rear holder 31, the rear holder 31 is held at a temporary lock position relative to the connector housing 30. As a result of engaging the full-lock portions 37 of the connector housing 30 with the lock engaging portions 38 of the rear holder 31, the rear holder 31 is held at a full-lock position relative to the connector housing 30.

The rear holder 31 is provided with a plurality of insertion holes 39 in which wires 11 are inserted and which are lined up in the left-to-right direction in upper and lower lows, i.e., two rows. The insertion holes 39 are provided at locations corresponding to the locations of the cavities 29 of the connector housing 30.

The inner diameter dimension of each insertion hole 39 is determined to be identical with or slightly larger than the outer diameter dimension of the insulating sheathing 14 of the wire 11.

The rear holder 31 has a hood 41 opening frontward, into which the connector housing 30 is inserted. The rear end of the hood 41 is provided with a pair of projecting walls 42A and 42B formed near the vertical center of the rear end, the projecting walls 42A and 42B projecting frontward in the hood 41 and being lined up vertically at intervals. The gap between the pair of projecting walls 42A and 42B in the vertical direction is determined to be identical with or slightly larger than the thickness dimension in the vertical direction of the partition 34 of the connector housing 30.

In a state in which the rear holder 31 is held at the temporary lock position relative to the connector housing 30, the pair of projecting walls 42A and 42B of the rear holder 31 are located more rearward than the rear edge of the partition 34 of the connector housing 30. In a state in which the rear holder 31 is held at the full-lock position relative to the connector housing 30, the partition 34 of the connector housing 30 is fitted in between the pair of projecting walls 42A and 42B of the rear holder 31. This suppresses a vertical positional shift of the rear holder 31 relative to the connector housing 30.

The inner wall of the hood 41 is formed such that the inner wall in an area including the front edge and a part extending slightly rearward from the front edge is thinner than the inner wall in the other area. As a result, on the inner wall of the hood 41, a step is formed between a part closer to the front end and the other part closer to the rear part. This step serves as a slide pushing portion 43 that when the rear holder 31 moves from the temporary lock position to the full-lock position relative to the connector housing 30, comes in contact from the rear side with the rear end 44 of the slide 16. This slide pushing portion 43 comes in contact from the rear side with the rear end 44 of the slide 16 to push the slide 16 frontward, thereby causes the slide 16 to move to the full-lock position.

(First Example of Process of Assembling Connector 10)

A first example of a process of assembling the connector 10 according to the present embodiment will then be described. The process of assembling the connector 10 will not be limited by the following description.

The terminal body 15 and the slide 16 are formed by a known method. The slide 16 is fitted from the rear side to the terminal body 15. The front edge of the slide 16 comes in contact from the rear side with the lock projections 28 of the terminal body 15. This causes the side walls of the slide 16 to deform to widen. Further pushing the slide 16 frontward causes the side walls of the slide 16 to deform again to return to their original state. As a result, the temporary lock engaging portions 26 of the slide 16 engage with the lock projections 28 of the terminal body 15. The slide 16 is thus held at the temporary lock position relative to the terminal body 15. Hence, the female terminal 12 has been constructed (see FIG. 3).

The connector housing 30 and the rear holder 31 are formed by injection molding a synthetic resin (see FIG. 19). The female terminal 12 is inserted from the rear side into the cavity 29 of the connector housing 30 (see FIGS. 20 and 21).

Figure 22:
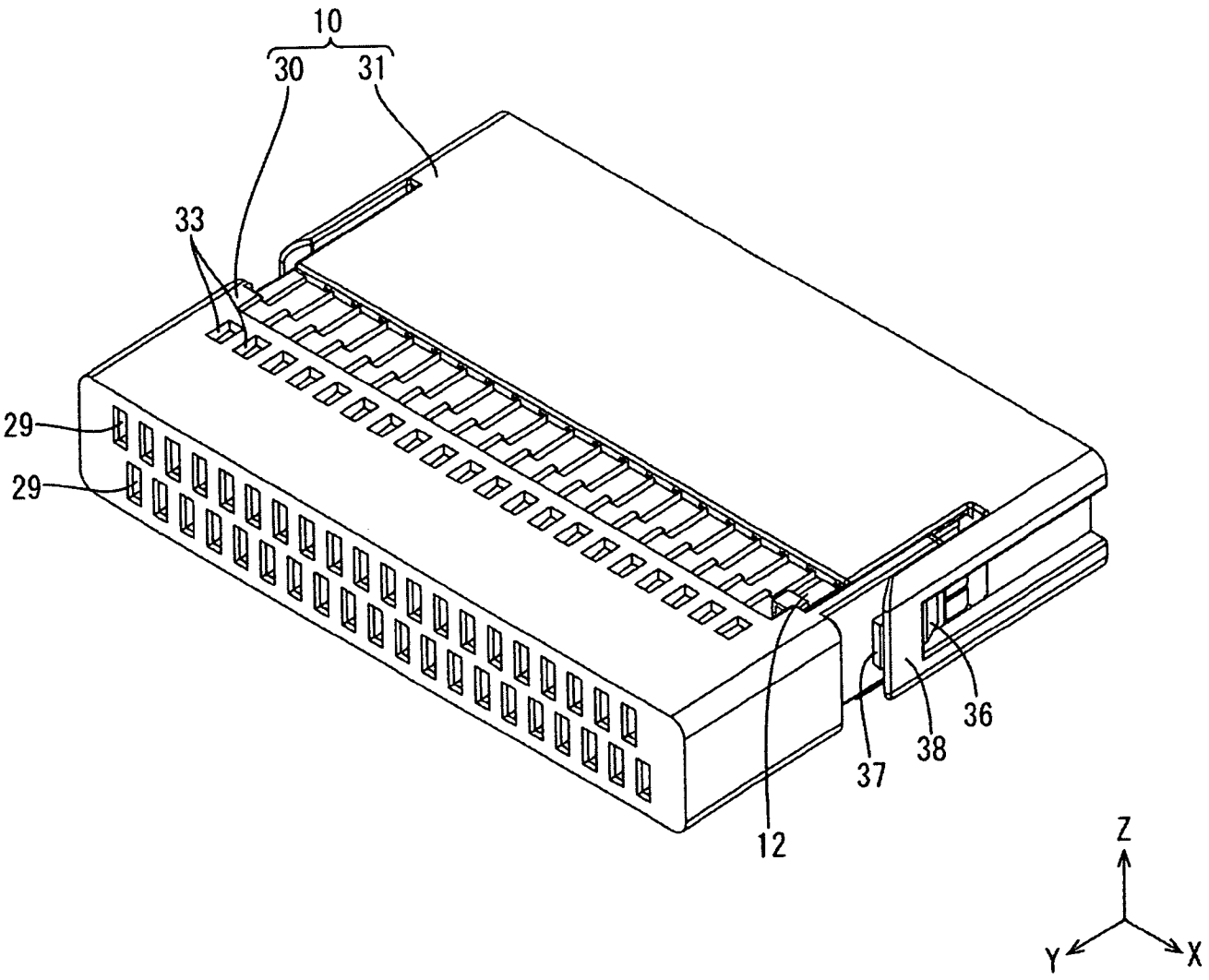
FIG. 22 is a perspective view showing a state in which the rear holder is fitted on the connector housing by being locked at a temporary lock position.
Figure 23:
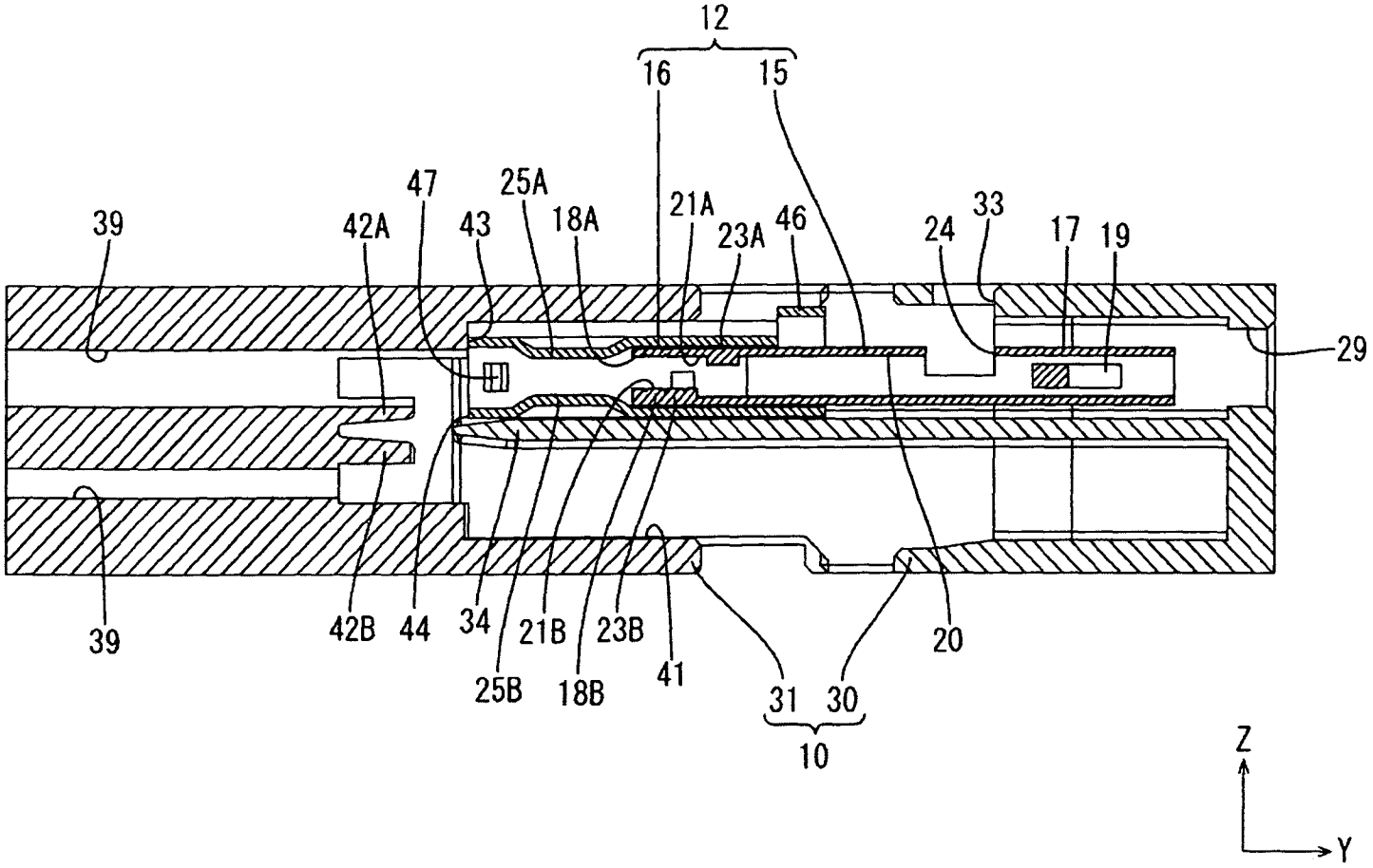
FIG. 23 is a sectional view showing a state in which the rear holder is fitted on the connector housing by being locked at the temporary lock position.
Figure 24:
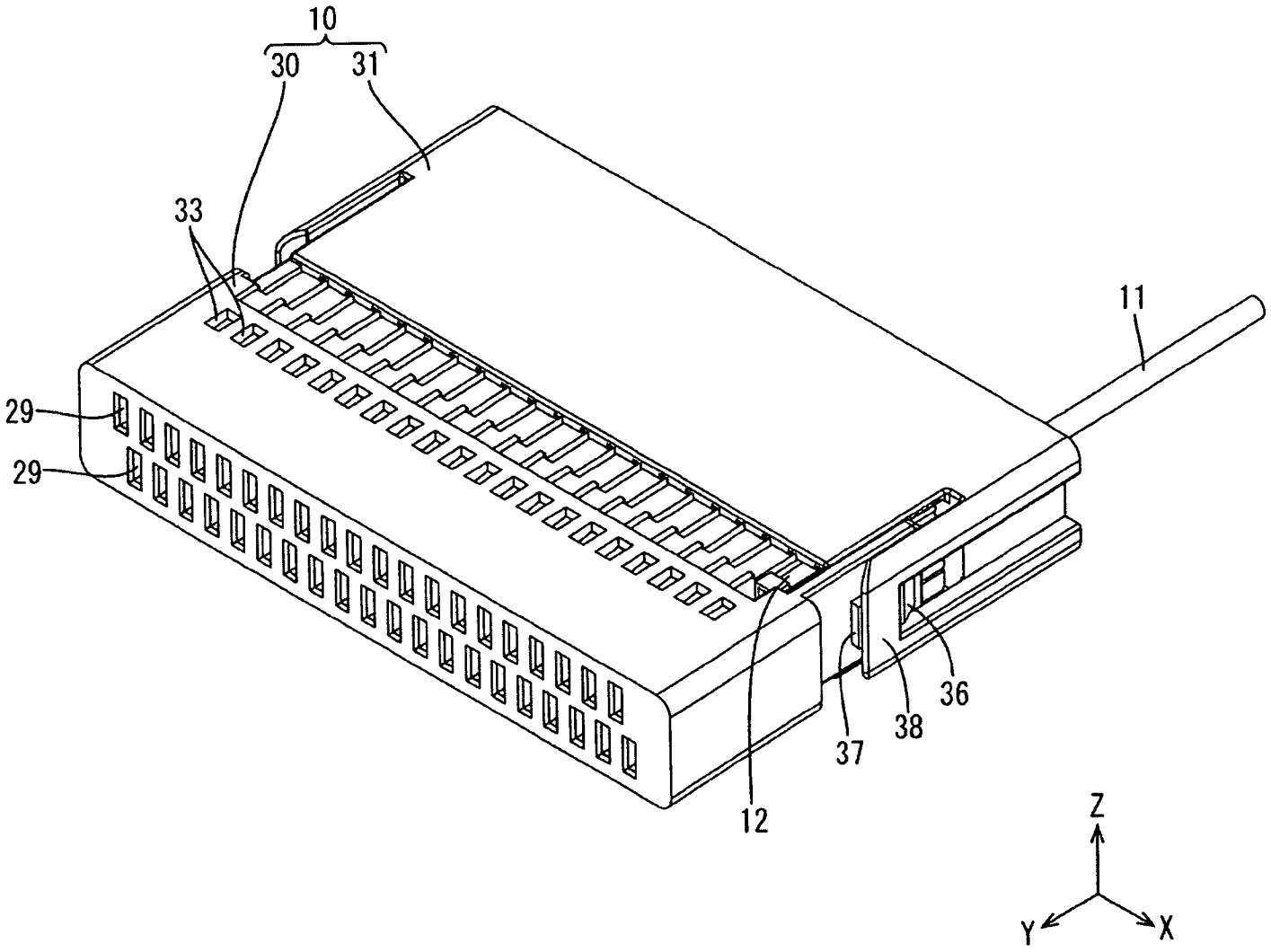
FIG. 24 is a perspective view showing a state in which a wire is inserted.

As shown in FIGS. 22 and 23, the rear holder 31 is fitted from the rear side onto the rear end of the connector housing 30. This causes the front end of the rear holder 31 to come in contact from the rear side with the temporary lock portions 36 of the connector housing 30. As a result, the front end of the rear holder 31 deforms to widen. Further pushing the rear holder 31 frontward causes the front end of the rear holder 31 to deform again to return to its original state. As a result, the lock engaging portions 38 of the rear holder 31 elastically engage with the temporary lock portions 36 of the connector housing 30. The rear holder 31 is thus held at the temporary lock position relative to the connector housing 30. In this state, the slide pushing portion 43 of the rear holder 31 is at a location separated rearward from the rear edge of the slide 16.

At the end of the wire 11, the insulating sheathing 14 is peeled to expose the core 13 of a predetermined length dimension. The front end of the core 13 is inserted from the rear side into the insertion hole 39 formed on the rear end of the rear holder 31.

Further pushing the wire 11 frontward causes the front end of the core 13 to project frontward from the insertion hole 39 of the rear holder 31, thus causing the core 13 to move from the rear end 44 of the slide 16 to the interior of the slide 16. The core 13 then comes in contact with the guide-in portions 47 of the slide 16 and is guided to the slide 16. Further pushing the wire 11 frontward causes the front end of the core 13 to proceed to the interior of the terminal body 15 and enter the space between the upper connection piece 18A and the lower connection piece 18B.

Figure 25:
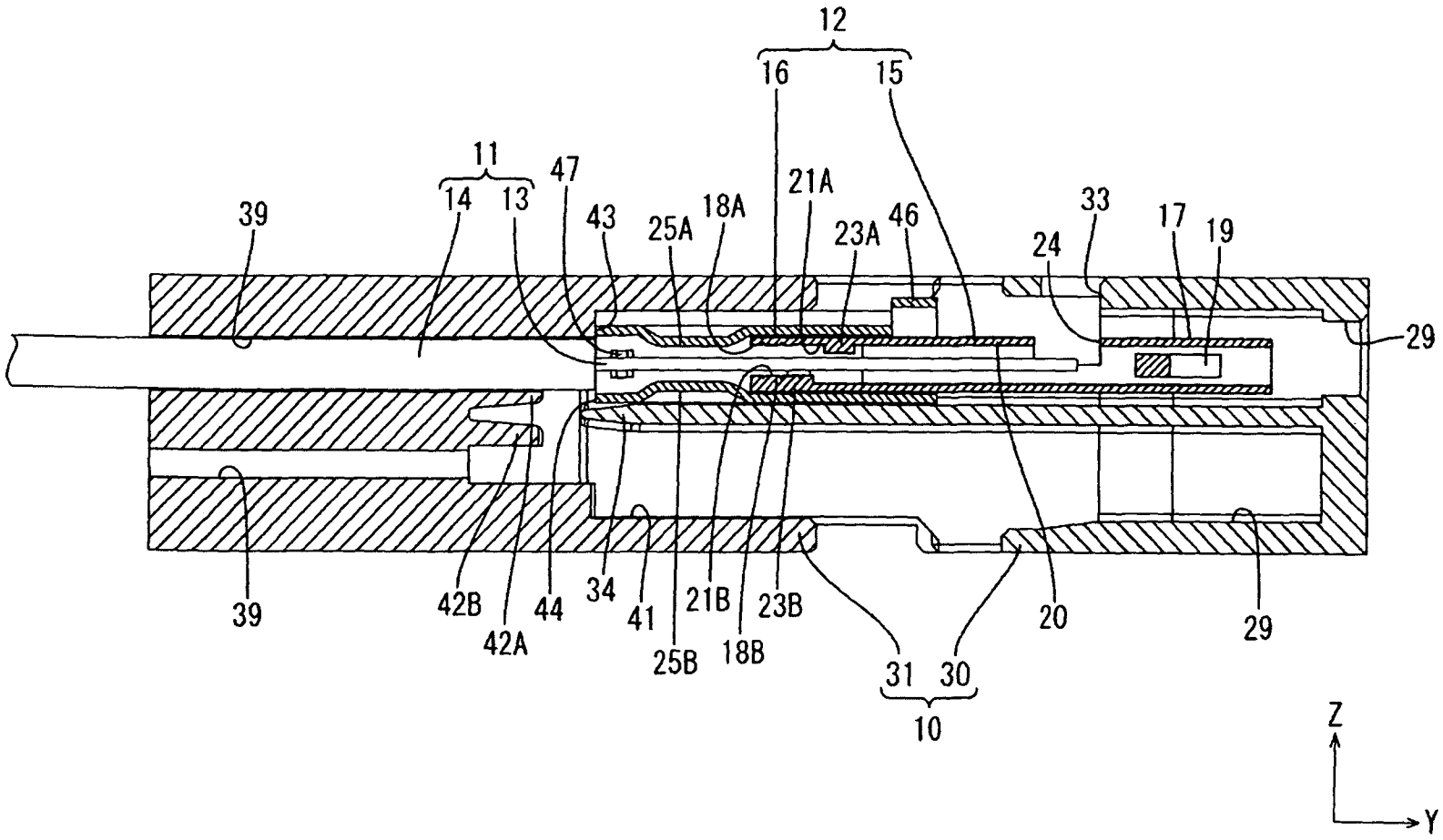
FIG. 25 is a sectional view showing a state in which the wire is inserted.

Subsequently, further pushing the wire 11 frontward causes the front end of the core 13 to reach a location under the terminal window 24 of the terminal body 15 (see FIG. 25). At this point, the front end of the core 13 can be detected by a visual check, probing, or the like through the terminal window 24 that can be visually recognized from the connector window 33. In this state, the insulating sheathing 14 of the wire 11 is located in the insertion hole 39 of the rear holder 31.

When the slide 16 is in a state of being held at the temporary lock position relative to the terminal body 15 and the rear holder 31 is in a state of being held at the temporary lock position relative to the connector housing 30, the gap between the upper connection piece 18A and the lower connection piece 18B is determined to be larger than the outer diameter dimension of the core 13. When the core 13 is inserted in the connector 10, therefore, the core 13 is not subjected to a large frictional force caused by friction with the upper connection piece 18A and the lower connection piece 18B. This reduces an insertion force by which the wire 11 is inserted in the connector 10.

Subsequently, the rear holder 31 is pushed frontward. This causes the front end of the rear holder 31 to climb over the full-lock portions 37 of the connector housing 30 and deform to widen. Further pushing the rear holder 31 frontward causes the slide pushing portion 43 of the rear holder 31 to come in contact from the rear side with the rear end 44 of the slide 16. The rear holder 31 is then pushed frontward further. As a result, the slide 16 pushed by the slide pushing portion 43 moves frontward relative to the terminal body 15. This action causes the lock projections 28 of the terminal body 15 to disengage from the temporary lock engaging portions 26 of the slide 16 and causes the side walls of the slide 16 to climb over the lock projections 28 to deform to widen.

Further pushing the rear holder 31 frontward causes the side walls of the slide 16 to deform again to return to their original state and causes the lock projections 28 of the terminal body 15 to engage with the full-lock engaging portions 27 of the slide 16. The slide 16 is thus held at full-lock position relative to the terminal body 15. At this point, the full-lock portions 37 of the connector housing 30 engage with the lock engaging portions 38 of the rear holder 31. The rear holder 31 is thus held at the full-lock position relative to the connector housing 30 (see FIGS. 1 and 2).

In a state in which the slide 16 is held at full-lock position relative to the terminal body 15, the upper contact portion 25A of the slide 16 comes in contact from above with the upper connection piece 18A of the terminal body 15 and presses the upper connection piece 18A downward. At the same time, the lower contact portion 25B of the slide 16 comes in contact from below with the lower connection piece 18B of the terminal body 15 and presses the lower connection piece 18B upward. As a result, the core 13 is held between the upper connection piece 18A on the upper side and the lower connection piece 18B on the lower side.

The serrations 22A formed on the lower surface of the upper connection piece 18A and the serrations 22B formed on the upper surface of the lower connection piece 18B cut into the oxide film formed on the surface of the core 13 to peel the oxide film. This exposes the metal surface making up the core 13. This metal surface comes in contact with the upper connection piece 18A and with the lower connection piece 18B. The wire 11 is this electrically connected to the female terminal 12.

When the core 13 is in a state of being held between the upper connection piece 18A on the upper side and the lower connection piece 18B on the lower side, the core 13 is held between the upper holding projection 23A of the upper connection piece 18A and the lower holding projection 23B of the lower connection piece 18B. The core 13 is thus held in a state of extending in the front-to-rear direction and being bent in the vertical direction. This holds the core 13 firmly, thus enhancing a holding force holding the wire 11 and the female terminal 12 together to resist a pulling force acting on the wire 11.

(Second Example of Process of Assembling Connector 10)

A second example of the process of assembling the connector 10 according to the present embodiment will then be described. According to the present manufacturing process, as shown in FIG. 26, the jig 45 is brought in contact from the rear side with the jig contact portion 46 to cause the slide 16 to slide frontward, and then the rear holder 31 is moved frontward.

Figure 26:
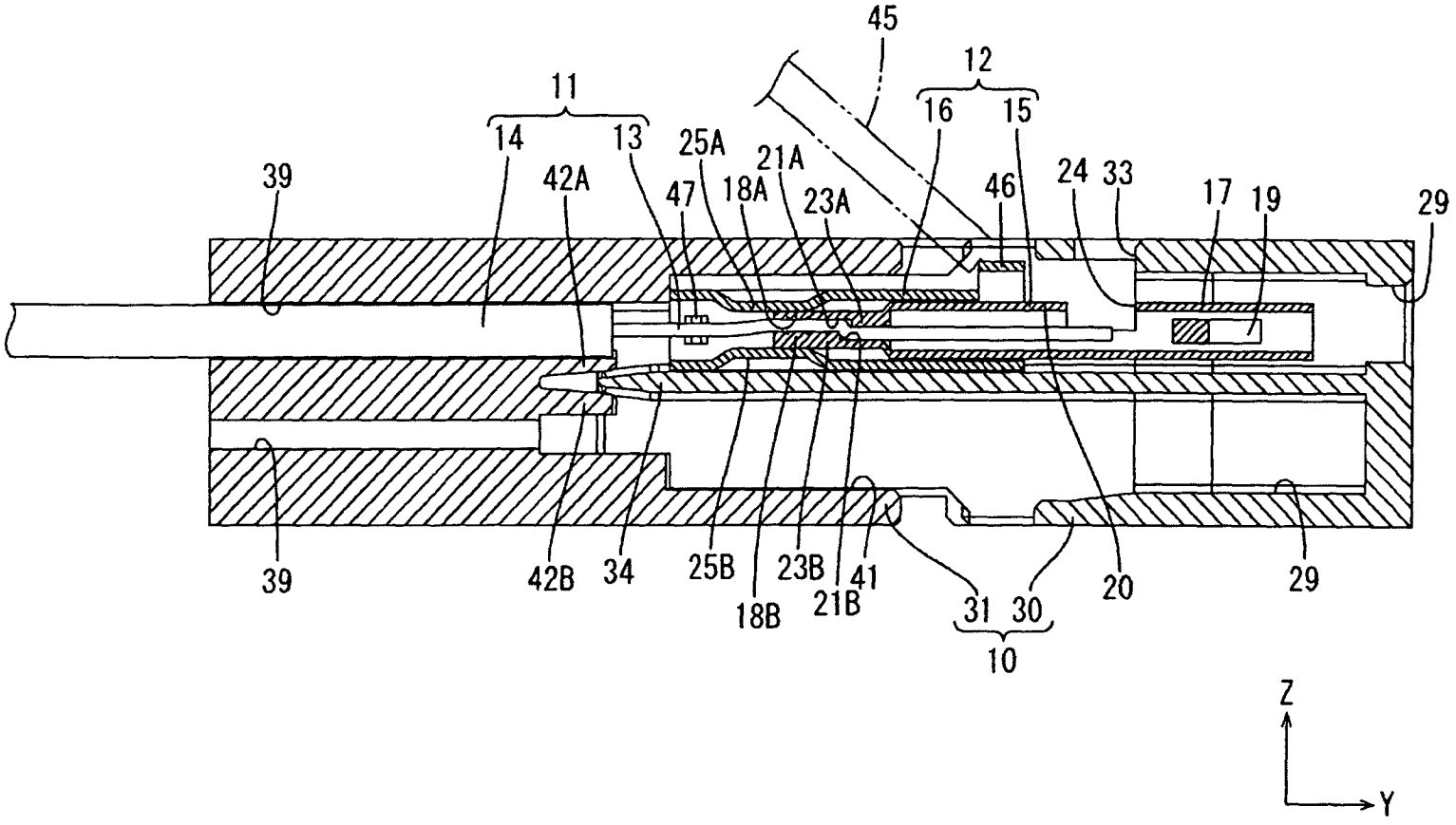
FIG. 26 is a sectional view showing a state in which the rear holder is in contact with the slide as the slide is not at a contact position.

In the course of moving the slide 16 to the full-lock position, the slide 16 may stop between the temporary lock position and the full-lock position, as shown in FIG. 26. In this state, electric connection between the core 13 and the upper connection piece 18A and the lower connection piece 18B is not sufficient. This is because that a contact pressure of the upper connection piece 18A and the lower connection piece 18B to the core 13 is not sufficient. In this state, trying to move the rear holder 31 from the temporary lock position to the full-lock position causes the slide pushing portion 43 of the rear holder 31 to come in contact with the rear end of the slide 16. Since the slide 16 is stopped, the rear holder 31 cannot move toward the full-lock position. By confirming this state, whether the slide 16 has moved to the full-lock position can be determined.

Assembling processes other than the above processes are substantially the same as those in the first example and therefore will not be described to avoid redundant descriptions.

Effects of Embodiment

Effects of the present embodiment will then be described. The female terminal 12 according to the present embodiment is the female terminal including the terminal body 15 including the deformable upper connection piece 18A and the deformable lower connection piece 18B having the contact surface 21A and the contact surface 21B that come in contact with the core 13 of the wire 11, respectively, the upper and lower connection pieces 18A and 18B extending in the extension direction, and the slide 16 configured to move along the extension direction. The slide 16 has the upper contact portion 25A and the lower contact portion 25B that press the upper connection piece 18A and the lower connection piece 18B, respectively, to the core 13 while the core 13 is disposed in contact with the contact surfaces 21A and 21B of the upper and lower connection pieces 18A and 18B along the extension direction.

According to this configuration, by moving the slide 16 along the extension direction, the upper connection piece 18A and the lower connection piece 18B can be pressed to the core 13. As a result, the upper connection piece 18A and the lower connection piece 18B are electrically connected to the core 13. Thus, the wire 11 and the female terminal 12 can be electrically connected together without using a relatively large jig, such as a die.

According to the present embodiment, the upper contact portion 25A and the lower contact portion 25B of the slide 16 come in contact with the upper connection piece 18A and the lower connection piece 18B from the sides opposite to the contact surface 21A and the contact surface 21B, respectively.

According to this configuration, by bringing the upper contact portion 25A and the lower contact portion 25B into contact with the upper connection piece 18A and the lower connection piece 18B from the side opposite to the contact surface 21A and the contact surface 21B, respectively, the upper connection piece 18A and the lower connection piece 18B can be pressed to the core 13 of the wire 11. Thus, the wire 11 and the female terminal 12 can be electrically connected together.

According to the present embodiment, the slide 16 is configured to move between the contact position at which the upper contact portion 25A and the lower contact portion 25B are in contact with the upper connection piece 18A and the lower connection piece 18B, respectively, and the separation position at which the upper contact portion 25A and the lower contact portion 25B are separated from the upper connection piece 18A and the lower connection piece 18B, respectively.

According to this configuration, by carrying out a simple operation of moving the slide 16 from the separation position to the contact position relative to the terminal body 15, the wire 11 and the female terminal 12 can be electrically connected together.

According to the present embodiment, the slide 16 is of a cylindrical shape extending in the extension direction and has the guide-in portions 47 located on the part of the slide 16 that is closer to the rear end of the slide 16 in the extension direction, and the guide-in portions 47 taper as the guide-in portions 47 extend frontward in the extension direction and come in slide contact with the core 13 of the wire 11 to guide the wire 11 to the interior of the slide 16.

According to this configuration, by causing the core 13 to come in slide contact with the guide-in portions 47, the core 13 can be inserted easily into the slide 16 of the cylindrical shape.

According to the present embodiment, the slide 16 is provided with the jig contact portion 46 projecting outward, and a push to the jig contact portion 46 by the jig 45 from the rear side of the jig contact portion 46 in the extension direction causes the slide 16 to slide frontward in the extension direction.

According to this configuration, by bringing the jig 45 into contact with the jig contact portion 46 to push the slide 16 frontward in the extension direction, the wire 11 and the female terminal 12 can be electrically connected together.

According to the present embodiment, the upper connection piece 18A has the upper holding projection 23A projecting from the contact surface 21A, and the lower connection piece 18B has the lower holding projection 23B projecting from the contact surface 21B. The upper holding projection 23A and the lower holding projection 23B come in contact with the core 13 of the wire 11 to hold the core 13 in a state of being bent in a direction intersecting the extension direction.

According to this configuration, because the upper holding projection 23A and the lower holding projection 23B hold the core 13 in the state of being bent in the direction intersecting the extension direction, when a pulling force acts on the wire 11, the upper holding projection 23A and the lower holding projection 23B receive such a pulling force. As a result, the wire 11 and the female terminal 12 are firmly held together.

The contact surfaces 21A and 21B have the serrations 22A and 22B formed thereon, respectively, and the serrations 22A and 22B cut into the surface of the core 13 while the upper connection piece 18A and the lower connection piece 18B are pressed to the core 13.

According to this configuration, the serrations 22A and 22B cutting into the surface of the core 13 enhance the holding force holding the core 13 and the female terminal 12 together. In addition, the serrations 22A and 22B peel off the insulative film covering the surface of the core 13. This reduces electric resistance between the core 13 and the female terminal 12.

The serrations 22A and 22B are formed as grooves extending in a direction perpendicular to the extension direction and are lined up at intervals in the extension direction.

According to this configuration, the core 13 can be held by the serrations 22A and 22B on a plurality of parts of the wire 11 in the extension direction. This enhances the holding force holding the core 13 and the female terminal 12 together. In addition, the core 13 can be electrically connected to the female terminal 12 by the serrations 22A and 22B on the plurality of parts of the wire 11 in the extension direction. This allows a reduction in electric resistance between the core 13 and the female terminal 12.

According to the present embodiment, the contact surface 21B has the wire guide recession 48 formed thereon, and the wire guide recession 48 extends along the extension direction.

According to this configuration, by laying the core 13 along the wire guide recession 48, the core 13 can be disposed easily on the contact surface 21B.

According to the present embodiment, the terminal body 15 has the terminal window 24 as the opening through which the edge of the core 13 being placed in the predetermined location is detectable while the core 13 is disposed along the upper connection piece 18A and the lower connection piece 18B.

According to this configuration, by detecting the edge of the core 13 through the terminal window 24, whether the core 13 is placed in the predetermined location and is connected to the female terminal 12 can be determined easily.

According to the present embodiment, the terminal body 15 is provided with the lock projections 28, and the slide 16 is provided with the temporary lock engaging portions 26 and the full-lock engaging portions 27. Engaging the lock projections 28 with the temporary lock engaging portions 26 holds the slide 16 at the temporary lock position. Engaging the lock projections 28 with the full-lock engaging portions holds the slide 16 at the full-lock position.

In this manner, relative to the terminal body 15, the slide 16 can be held at the temporary lock position and the full-lock position as well.

The connector 10 according to the present embodiment is the connector including the connector housing 30 having the cavities 29 in which the female terminal 12 is housed, and the rear holder 31 fitted on the rear end of the connector housing 30. On the rear end of the rear holder 31, the insertion holes 39 are formed as openings communicating respectively with the cavities 29.

According to this configuration, the rear holder 31 holds the female terminal 12 in the connector housing 30 such that the female terminal 12 is prevented from slipping off.

According to the present embodiment, the slide 16 has the upper contact portion 25A that comes in contact with the upper connection piece 18A from the side opposite to the contact surface 21A, and the lower contact portion 25B that comes in contact with the lower connection piece 18B from the side opposite to the contact surface 21B. The slide 16 is configured to move between the contact position at which the upper contact portion 25A and the lower contact portion 25B are in contact with the upper connection piece 18A and the lower connection piece 18B, respectively, and the separation position at which the upper contact portion 25A and the lower contact portion 25B are separated from the upper connection piece 18A and the lower connection piece 18B, respectively. The rear holder 31 is configured to move along the extension direction, and has the slide pushing portion 43 formed on the front end of the rear holder 31 in the extension direction, and the slide pushing portion 43 comes in contact with the slide 16 from the rear side in the extension direction to push the slide 16 frontward in the extension direction, thereby moving the slide 16 to the contact position when the rear holder 31 moves from the rear side to the front side in the extension direction.

According to this configuration, moving the rear holder causes the slide pushing portion of the rear holder to push the slide. As the rear holder is moved, therefore, the wire and the terminal are electrically connected together at the same time.

According to the present embodiment, the rear holder 31 is configured to move along the front-to-rear direction, and has the slide pushing portion 43 formed on the front end of the rear holder 31, and the slide pushing portion 43 comes in contact with the slide 16 from the rear side to push the slide 16 frontward, thereby moving the slide 16 to the full-lock position when the rear holder 31 moves from the rear side to the front side.

According to this configuration, moving the rear holder 31 from the rear side to the front side causes the slide pushing portion 43 of the rear holder 31 to push the slide 16. The slide 16 is thus moved to the full-lock position. As a result, the upper contact portion 25A and the lower contact portion 25B of the slide 16 come in contact with the upper connection piece 18A and the lower connection piece 18B, respectively, thereby press the upper connection piece 18A and the lower connection piece 18B toward the core 13. The upper connection piece 18A and the lower connection piece 18B thus cause the core 13 to deform and come in contact with the upper connection piece 18A and the lower connection piece 18B. As a result, the wire 11 is electrically connected to the female terminal 12. According to the present configuration, by a single action of moving the rear holder 31 from the rear side to the front side in the extension direction, the wire 11 and the female terminal 12 can be electrically connected together.

According to the present embodiment, the front end of the rear holder 31 in the extension direction is in contact with the slide 16 when the slide 16 is not at the contact position.

According to this configuration, a state in which the core 13 and the female terminal 12 are incompletely connected because of the slide 16 not being at the contact position can be detected by confirming a fact that the front end of the rear holder 31 is in contact with the slide 16.

According to the present embodiment, the terminal body 15 has the terminal window 24 through which the edge of the core 13 can be visually confirmed from outside while the core 13 is disposed along the upper connection piece 18A and the lower connection piece 18B.

According to this configuration, the edge of the core 13 disposed in the female terminal 12 can be confirmed from the terminal window 24. Whether the core 13 is disposed at a predetermined location relative to the upper connection piece 18A and the lower connection piece 18B, therefore, can be checked easily.

According to the present embodiment, the connector housing is provided with the connector window 33 through which the terminal window 24 of the female terminal 12 can be visually confirmed from outside.

According to this configuration, the edge of the core 13 disposed in the female terminal 12 can be confirmed from the connector window 33. Whether the core 13 is disposed at a predetermined location relative to the connection pieces 18, therefore, can be checked easily.

Second Embodiment

Figure 27:
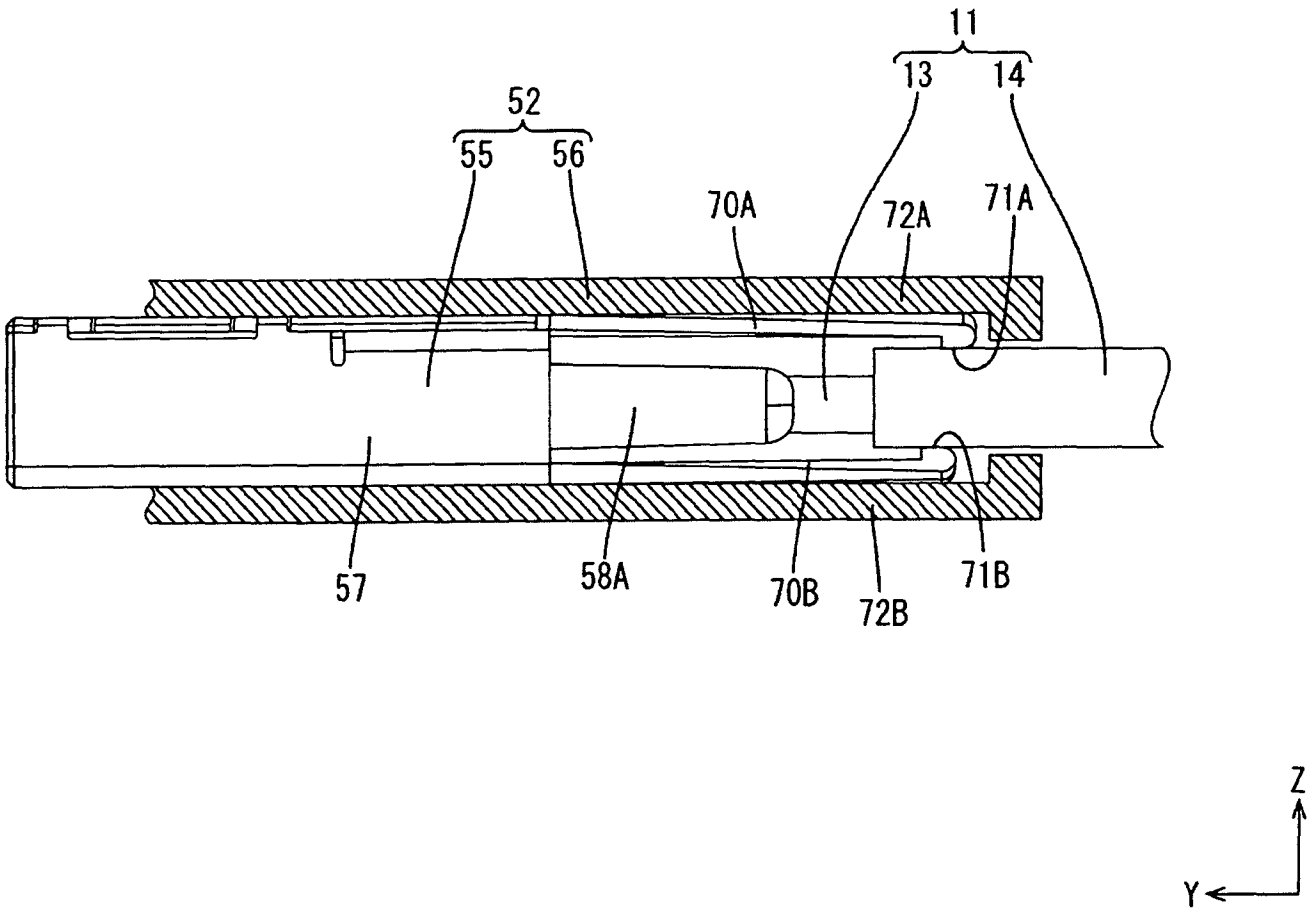
FIG. 27 is a sectional view of a female terminal according to a second embodiment.
Figure 28:
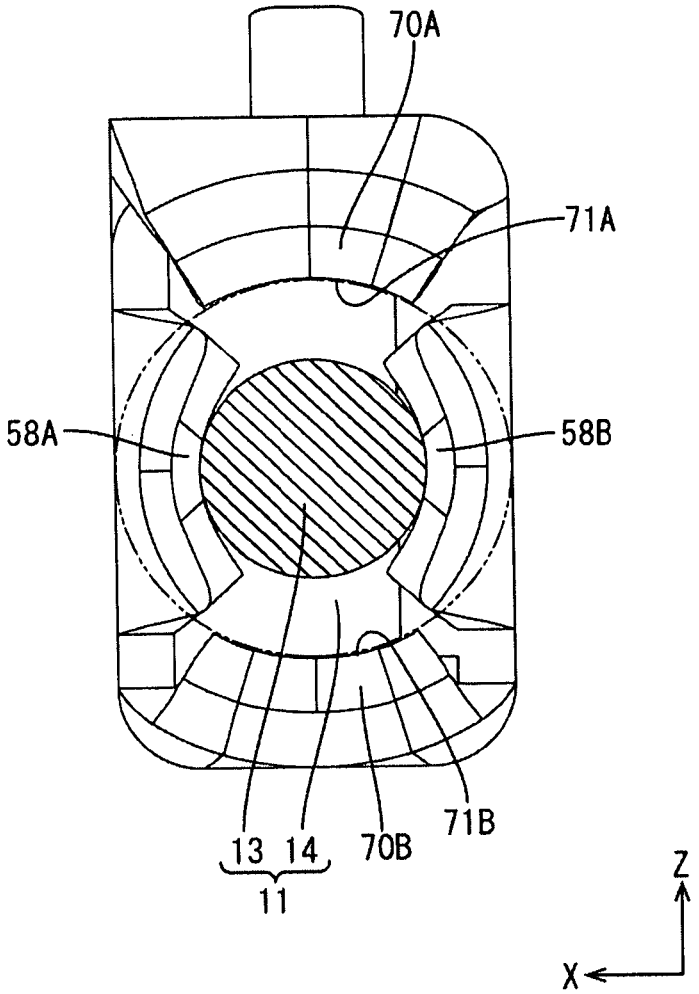
FIG. 28 is a rear view of the female terminal.

A second embodiment of the technique disclosed in the present description will then be described with reference to FIGS. 27 and 28. A female terminal 52 according to the present embodiment includes a terminal body 55 and a slide 56. The terminal body 55 has a pair of connection pieces 58A and 58B extending rearward from the rear ends of left/right side walls of a connection cylindrical portion 57.

On the rear edge of an upper wall of the connection cylindrical portion 57, an upper holding piece 70A is formed to extend rearward. The upper holding piece 70A is elastically deformable in the vertical direction. The rear edge of the upper holding piece 70A extends more rearward than the rear edge of the connection pieces 58A and 58B. On the rear edge of a lower wall of the connection cylindrical portion 57, a lower holding piece 70B is formed to extend rearward. The lower holding piece 70B is elastically deformable in the vertical direction. The rear edge of the lower holding piece 70B extends more rearward than the rear edge of the connection pieces 58A and 58B. The rear edge of the upper holding piece 70A extends more rearward than the rear edge of the lower holding piece 70B.

A lower surface of a rear end portion of the upper holding piece 70A serves as an upper holding surface 71A. The upper holding surface 71A is of an arcuate shape. An upper surface of a rear end portion of the lower holding piece 70B serves as a lower holding surface 71B. The lower holding surface 71B is of an arcuate shape.

A front end portion of the insulating sheathing 14 of the wire 11 is peeled such that the core 13 is located between the upper holding surface 71A of the upper holding piece 70A and the lower holding surface 71B of the lower holding piece 70B while the core 13 is disposed at the location corresponding to the location of the pair of connection pieces 58A and 58B.

A slide 56 is provided with an upper holding piece contact portion 72A that, as the slide 56 is at a full-lock position, comes in contact from a side (from above) opposite to the upper holding surface 71A with the upper holding piece 70A to press the upper holding piece 70A downward. The slide 56 is provided also with a lower holding piece contact portion 72B that, as the slide 56 is at the full-lock position, comes in contact from a side (from below) opposite to the lower holding surface 71B with the lower holding piece 70B to press the lower holding piece 70B upward.

When the slide 56 is in the state of being held at the full-lock position relative to the terminal body 55, the upper holding piece contact portion 72A presses the upper holding piece 70A from above to cause the upper holding piece 70A to elastically deform downward. At the same time, the lower holding piece contact portion 72B presses the lower holding piece 70B from below to cause the lower holding piece 70B to elastically deform upward. As a result, when the insulating sheathing 14 is disposed in a space between the upper holding piece 70A and the lower holding piece 70B and the slide 56 is held at the full-lock position relative to the terminal body 55, the insulating sheathing 14 is held between the upper holding piece 70A elastically deformed on the upper side and the lower holding piece 70B elastically deformed on the lower side.

Configurations other than the above configuration are substantially the same as the configurations of the first embodiment. The same members as described in the first embodiment will therefore be denoted by the same reference symbols and redundant descriptions will be omitted.

According to the present embodiment, while the insulating sheathing 14 is disposed along the front-to-rear direction between the upper holding surface 71A of the upper holding piece 70A and the lower holding surface 71B of the lower holding piece 70B and the slide 16 is at the contact position, the upper holding piece contact portion 72A and the lower holding piece contact portion 72B come in contact with the upper holding piece 70A and the lower holding piece 70B, respectively, to presses the upper holding piece 70A and the lower holding piece 70B to the insulating sheathing 14. As a result, the insulating sheathing 14 of the wire 11 is held by the upper holding piece 70A and the lower holding piece 70B. This enhances a holding force applied to the wire 11.

Other Embodiments

The technique disclosed in the present description is not limited to the embodiments described above with reference to the drawings. For example, the following embodiments are also included in the scope of the technique disclosed in the present description.

(1) The first embodiment defines the configuration in which one terminal body 15 is provided with the upper connection piece 18A and the lower connection piece 18B. In another embodiment, however, one terminal body 15 may be provided one connection piece or three or more connection pieces.

(2) The first embodiment defines the terminal as the female terminal 12. In another embodiment, however, the terminal may be a male terminal or a so-called round terminal having a bolt insertion hole formed on a disc-shaped connection portion of the terminal.

(3) The first embodiment defines the configuration in which the upper holding projection 23A and the lower holding projection 23B are provided to hold the insulating sheathing 14. However, the upper holding projection 23A and the lower holding projection 23B may be omitted.

(4) The first embodiment defines the configuration in which the terminal body 15 is provided with the terminal window 24 and the connector housing 30 is provided with the connector window 33. However, the terminal window 24 may be omitted and the connector window 33 may also be omitted as well.

(5) In the first embodiment, the opening edge of the insertion hole 39 of the rear holder 31 is provided with the guide-in portion 47. This guide-in portion 47, however, may be omitted.

(6) In the first embodiment, the rear holder 31 is provided with the slide pushing portion 43 that pushes the slide 16. This slide pushing portion 43, however, may be omitted.

(7) In the first embodiment, the cavities 29 are provided as two lows of cavities. The cavities 29, however, may be provided as one low or three or more lows of cavities.

(8) The first embodiment defines the slide 16 made of a metal. In another embodiment, however, the slide 16 may be made of any given material, such as synthetic resin and ceramic.

(9) The first embodiments define the configuration in which the upper connection piece 18A and the lower connection piece 18B deform elastically. The upper connection piece 18A and the lower connection piece 18B, however, may deform plastically.

(10) The first and second embodiments define the wire 11 as the sheathed wire constructed by sheathing the outer periphery of the core 13 with the insulating sheathing 14. The wire 11, however, may be a bare wire.

(11) In the first and second embodiments, the slide 16 is of a rectangular cylindrical shape. In another embodiment, however, the slide 16 may be of a circular cylindrical shape or a polygonal cylindrical shape, such as a triangular cylindrical shape, a pentagonal cylindrical shape, and a hexagonal cylindrical shape.

(12) The first embodiment defines the configuration in which the slide 16 is provided with the temporary lock engaging portion 26. The temporary lock engaging portion 26, however, may be omitted.

EXPLANATION OF SYMBOLS

10: Connector
11: Wire
12: Female terminal (Example of terminal)
13: Core
14: Insulating sheathing
15: Terminal body
16: Slide
18A: Upper connection piece (Example of connection piece)
18B: Lower connection piece (Example of connection piece)
21A, 21B: Contact surface
23A: Upper holding projection (Example of holding projection)
23B: Lower holding projection (Example of holding projection)
24: Terminal window
25A: Upper contact portion (Example of contact portion)
25B: Lower contact portion (Example of contact portion)
26: Temporary lock engaging portion (Example of separation position lock engaging portion)
27: Full-lock engaging portion (Example of contact position lock engaging portion)
28: Lock projection (Example of separation position lock portion and contact position lock portion)
29: Cavity
30: Connector housing
31: Rear holder
33: Connector window
39: Insertion hole
43: Slide pushing portion
45: Jig
46: Jig contact portion
47: Guide-in portion
48: Wire guide recession
70A: Upper holding piece (Example of holding piece)
70B: Lower holding piece (Example of holding piece)
71A, 71B: Holding surface
72A: Upper holding piece contact portion (Example of holding piece contact portion)
72B: Lower holding piece contact portion (Example of holding piece contact portion)

What is claimed is:

1. A terminal comprising:

a terminal body including a deformable connection piece having a contact surface that comes in contact with a wire, the connection piece extending in an extension direction; and a slide configured to move relative to the terminal body along the extension direction, wherein the slide is of a cylindrical shape extending in the extension direction and has a pressing portion that presses the connection piece to the wire while the wire is disposed in contact with the contact surface of the connection piece along the extension direction.

2. The terminal according to claim 1, wherein the pressing portion of the slide is a contact portion that comes in contact with the connection piece from a side opposite to the contact surface.

3. The terminal according to claim 2, wherein the slide is configured to move between a contact position at which the contact portion is in contact with the connection piece and a separation position at which the contact portion is separated from the connection piece.

4. The terminal according to claim 1, wherein the slide has a guide-in portion located on a part of the slide that is closer to a rear end of the slide in the extension direction, and the guide-in portion tapers as the guide-in portion extends frontward in the extension direction and comes in slide contact with the wire to guide the wire to an interior of the slide.

5. The terminal according to claim 1, wherein the slide is provided with a jig contact portion projecting outward, and a push to the jig contact portion by a jig from a rear side of the jig contact portion in the extension direction causes the slide to slide frontward in the extension direction.

6. The terminal according to claim 1, wherein the connection piece has a holding projection projecting from the contact surface, and the holding projection comes in contact with the wire to hold the wire in a state of being bent in a direction intersecting the extension direction.

7. The terminal according to claim 1, wherein the contact surface has serrations formed thereon, and the serrations cut into a surface of the wire while the connection piece is pressed to the wire.

8. The terminal according to claim 7, wherein the serrations are formed as grooves extending in a direction perpendicular to the extension direction and are lined up at intervals in the extension direction.

9. The terminal according to claim 1, wherein the contact surface has a wire guide recession formed thereon, and the wire guide recession extends along the extension direction.

10. The terminal according to claim 1, wherein the wire has a core and an insulating sheathing covering an outer periphery of the core, the terminal body has a deformable holding piece having a holding surface that holds the insulating sheathing, the holding piece extends in the extension direction, the slide has a holding piece contact portion projecting toward the holding piece, and the holding piece contact portion comes in contact with the holding piece to press the holding piece to the insulating sheathing.

11. The terminal according to claim 1, wherein the terminal body has a terminal window as an opening through which an edge of the wire being placed in a predetermined location is detectable while the wire is disposed along the connection piece.

12. The terminal according to claim 1, wherein one of the terminal body and the slide is provided with a separation position lock portion while the other of the terminal body and the slide is provided with a separation position lock engaging portion, engaging the separation position lock portion with the separation position lock engaging portion holds the slide at the separation position, one of the terminal body and the slide is provided with a contact position lock portion while the other of the terminal body and the slide is provided with a contact position lock engaging portion, and engaging the contact position lock portion with the contact position lock engaging portion holds the slide at the contact position.

13. A connector comprising:

a connector housing having a cavity in which the terminal according to claim 1 is housed; and a rear holder fitted on a rear end of the connector housing in the extension direction of the terminal housed in the cavity, wherein on a rear end of the rear holder in the extension direction, an insertion hole is formed as an opening communicating with the cavity.

14. The connector according to claim 13, wherein the slide has a contact portion that comes in contact with the connection piece from a side opposite to the contact surface, the slide is configured to move between a contact position at which the contact portion is in contact with the connection piece and a separation position at which the contact portion is separated from the connection piece, the rear holder is configured to move along the extension direction, the rear holder has a slide pushing portion on a front end of the rear holder in the extension direction, and the slide pushing portion comes in contact with the slide from a rear side in the extension direction to push the slide frontward in the extension direction, thereby moving the slide to the contact position when the rear holder moves from the rear side to the front side in the extension direction.

15. The connector according to claim 13, wherein, the slide has a contact portion that comes in contact with the connection piece from a side opposite to the contact surface, the slide is configured to move between a contact position at which the contact portion is in contact with the contact surface and a separation position at which the contact portion is separated from the connection piece, the rear holder is configured to move between a temporary lock position at which the rear holder is locked at a location closer to a rear end of the connector housing and a full-lock position located more frontward in the extension direction than the temporary lock position, and the front end of the rear holder in the extension direction is in contact with the slide when the slide is not at the contact position.

16. The connector according to claim 13, wherein the terminal body has a terminal window as an opening through which an edge of the wire being placed in a predetermined location is detectable while the wire is disposed along the connection piece, and the connector housing is provided with a connector window through which the terminal window of the terminal communicates with an outside.

17. A terminal comprising:

a terminal body including a deformable connection piece having a contact surface that comes in contact with a wire, the connection piece extending in an extension direction; and a slide configured to move relative to the terminal body along the extension direction, wherein the slide has a pressing portion that presses the connection piece to the wire while the wire is disposed in contact with the contact surface of the connection piece along the extension direction, one of the terminal body and the slide is provided with a separation position lock portion while the other of the terminal body and the slide is provided with a separation position lock engaging portion, engaging the separation position lock portion with the separation position lock engaging portion holds the slide at the separation position, one of the terminal body and the slide is provided with a contact position lock portion while the other of the terminal body and the slide is provided with a contact position lock engaging portion, and engaging the contact position lock portion with the contact position lock engaging portion holds the slide at the contact position.

* * * * *